US009821555B2

(12) United States Patent
Enomoto et al.

(10) Patent No.: US 9,821,555 B2
(45) **Date of Patent: *Nov. 21, 2017**

(54) LIQUID EJECTING HEAD AND LIQUID EJECTING APPARATUS

(71) Applicant: SEIKO EPSON CORPORATION, Tokyo (JP)

(72) Inventors: Katsumi Enomoto, Kanagawa-ken (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,392

(22) Filed: Mar. 1, 2016

(65) Prior Publication Data

US 2016/0176190 A1 Jun. 23, 2016

Related U.S. Application Data

(63) Continuation of application No. 14/455,770, filed on Aug. 8, 2014, now Pat. No. 9,302,480.

(30) Foreign Application Priority Data

Aug. 9, 2013 (JP) ..... 2013-167010

(51) Int. Cl.
*B41J 2/14* (2006.01)

(52) U.S. Cl.
CPC ..... *B41J 2/1433* (2013.01); *B41J 2/14145* (2013.01); *B41J 2/14201* (2013.01);
(Continued)

(58) Field of Classification Search
CPC .. B41J 2/1433; B41J 2/14201; B41J 2/14145; B41J 2/14233; B41J 2002/14306;
(Continued)

(56) References Cited

U.S. PATENT DOCUMENTS 9,302,480 B2 * 4/2016 Enomoto ..... B41J 2/14201
2003/0218659 A1 11/2003 Ito
(Continued)

FOREIGN PATENT DOCUMENTS

JP 2004-209855 7/2004
JP 2005-178222 7/2005
(Continued)

*Primary Examiner* — Geoffrey Mruk
(74) *Attorney, Agent, or Firm* — Workman Nydegger

(57) ABSTRACT

A liquid ejecting head includes a liquid discharge unit with a pressure generating chamber group which communicates with a nozzle disposed on a nozzle surface and is formed from pressure generating chambers disposed in a first direction, and a case member which communicates with the pressure generating chamber group and holds a liquid. The case member has a liquid inlet on the side opposite to the liquid discharge direction and at a position between the pressure generating chambers at both ends in the first direction. First and second liquid discharge units are arranged at positions where the first directions of the first and second liquid discharge units are parallel to each other in a second direction that is orthogonal to the first direction, and positions of the liquid inlets of the case member respectively corresponding to the first and second liquid discharge units do not overlap in the second direction.

18 Claims, 13 Drawing Sheets

(52) U.S. Cl.
CPC .. *B41J 2/14233* (2013.01); *B41J 2002/14241* (2013.01); *B41J 2002/14306* (2013.01); *B41J 2002/14419* (2013.01); *B41J 2002/14491* (2013.01)

(58) Field of Classification Search
CPC .... B41J 2002/14241; B41J 2002/14419; B41J 2002/14491; B41J 2/135; B41J 2/14016; B41J 2/1404
See application file for complete search history.

(56) References Cited

U.S. PATENT DOCUMENTS

| | | | |
|---|---|---|---|
| 2004/0179061 | A1 | 9/2004 | Akahane |
| 2007/0058005 | A1 | 3/2007 | Kanaya |
| 2007/0273733 | A1 | 11/2007 | Kotaki et al. |
| 2010/0091071 | A1 | 4/2010 | Owaki |
| 2010/0149254 | A1 | 6/2010 | Yajima et al. |
| 2013/0127956 | A1 | 5/2013 | Watanabe et al. |
| 2014/0240409 | A1 | 8/2014 | Watanabe et al. |
| 2016/0250852 | A1 | 9/2016 | Watanabe et al. |

FOREIGN PATENT DOCUMENTS

| | | | |
|---|---|---|---|
| JP | 2007-076107 | A | 3/2007 |
| JP | 2007-313867 | A | 12/2007 |
| JP | 2010-115918 | | 5/2010 |
| JP | 2010-137428 | A | 6/2010 |
| JP | 2011-156766 | | 8/2011 |
| JP | 2011-167854 | | 9/2011 |
| JP | 2013-129191 | | 7/2013 |

* cited by examiner

LIQUID EJECTING HEAD AND LIQUID EJECTING APPARATUS

This application is a continuation application of U.S. patent application Ser. No. 14/455,770, filed Aug. 8, 2014, now U.S. Pat. No. 9,302,480, which patent application is incorporated herein by reference in its entirety. U.S. patent application Ser. No. 14/455,770 claims the benefit of and priority to Japanese Patent Application No: 2013-167010, filed Aug. 9, 2013 is expressly incorporated by reference herein in its entirety.

BACKGROUND

1. Technical Field

The present invention relates to a liquid ejecting head that ejects a liquid from a nozzle, and a liquid ejecting apparatus and, more particularly, to an ink jet type recording head that discharges ink as a liquid, and an ink jet type recording apparatus.

2. Related Art

Representative examples of liquid ejecting heads that discharge liquid droplets include ink jet type recording heads that discharge ink droplets. Proposed as an example of the ink jet type recording heads is an ink jet type recording head that includes a head chip. The head chip has a flow path forming substrate where a pressure generating chamber communicating with a nozzle is formed. The head chip further has a case member where a wiring substrate that is connected to a pressure generating unit which is disposed in the head chip is held. The head chip also has a flow path member that is disposed on a liquid inlet of the case member (for example, refer to JP-A-2010-115918).

SUMMARY

The connection between the case member and the flow path member is performed by connecting the flow path member to the inlet disposed in the case member. However, when the adjacent inlet is close, a sufficient thickness of the flow path member that forms a flow path which communicates with both cannot be ensured, and the required strength of the flow path member cannot be ensured and an area of adhesion is insufficient between the case member and the flow path member. In addition, the formation and arrangement of the flow path in the flow path member are subjected to constraints and, particularly, constraints are imposed in reducing the size of the head as a whole.

The disadvantages described above are not limited to the ink jet type recording head but similar disadvantages are also present in liquid ejecting heads that eject other liquids.

An advantage of some aspects of the invention is that a liquid ejecting head and a liquid ejecting apparatus that can be compact in size are provided.

According to an aspect of the invention, there is provided a liquid ejecting head including a liquid discharge unit that has a pressure generating chamber group which communicates with a nozzle disposed on a nozzle surface and is formed from a plurality of pressure generating chambers disposed in a first direction, and a case member which communicates with the pressure generating chamber group and holds a liquid, in which the case member has at least one liquid inlet on the side opposite to the liquid discharge direction and at a position between the pressure generating chambers at both ends in the first direction in a plan view of the pressure generating chamber group from the opposite side, and a first liquid discharge unit and a second liquid discharge unit are arranged at positions where the first directions of the first liquid discharge unit and the second liquid discharge unit are substantially parallel to each other in a second direction that is orthogonal to the first direction, and positions of the liquid inlets of the case member respectively corresponding to the first liquid discharge unit and the second liquid discharge unit do not overlap in the second direction.

In this aspect, the positions of the liquid inlets respectively corresponding to the first liquid discharge unit and the second liquid discharge unit do not overlap in the second direction, and thus a gap between rows of the nozzles can remain narrow and a sufficient thickness can be ensured for the flow path member that forms the flow paths which are connected to the liquid inlets of the first liquid discharge unit and the second liquid discharge unit, which results in a reduction in size.

Herein, it is preferable that the flow path member, which has merging flow paths communicating respectively with the liquid inlet of the first liquid discharge unit and the liquid inlet of the second liquid discharge unit, be disposed across the first liquid discharge unit and the second liquid discharge unit. In this case, the head can be further compact in size.

In addition, it is preferable that a filter that is disposed upstream the flow path which communicates with the liquid inlet of the first liquid discharge unit and a filter that is disposed upstream the flow path which communicates with the liquid inlet of the second liquid discharge unit be integrated with each other. In this case, the head can be further compact in size and the efficiency of the assembly operation can be further enhanced.

In addition, in a case where the first liquid discharge unit and the second liquid discharge unit is a unit pair and a plurality of the unit pairs are present in a juxtaposed manner, it is preferable that positions of the liquid inlet of one of the unit pairs on the other unit pair side and the liquid inlet of the other unit pair on the one unit pair side do not overlap in the second direction. In this case, the positions of the liquid inlet of the one unit pair on the other unit pair side and the liquid inlet of the other unit pair on the one unit pair side do not overlap in the second direction, and thus the gap between the rows of the nozzles can remain narrow and a sufficient thickness can be ensured for the flow path member that forms the flow paths, which results in a further reduction in size.

In addition, it is preferable that a flow path member, which has merging flow paths respectively communicating with the liquid inlet of the first liquid discharge unit and the liquid inlet of the second liquid discharge unit of the one unit pair and a liquid inlet of the first liquid discharge unit and the liquid inlet of the second liquid discharge unit of the other unit pair, be disposed across all of the first liquid discharge units and the second liquid discharge units of the one unit pair and the other unit pair. In this case, the head can be further compact in size.

In addition, it is preferable that a filter that is disposed upstream the flow paths which communicate with the liquid inlets of all of the first liquid discharge units and a filter that is disposed upstream the flow paths which communicate with the liquid inlets of all of the second liquid discharge units of the one unit pair and the other unit pair be integrated with each other. In this case, the head can be further compact in size and the efficiency of the assembly operation can be further enhanced.

In addition, it is preferable that the liquid inlet of the first liquid discharge unit and the liquid inlet of the second liquid discharge unit be disposed at the center between the pressure generating chambers at both of the ends in the first direction. In this case, it is possible to have the positions of the liquid inlets respectively corresponding to the first liquid discharge unit and the second liquid discharge unit do not overlap in the second direction through a modification in arrangement without modifying the design of components. As such, the gap between the rows of the nozzles can remain narrow and a sufficient thickness can be ensured for the flow path member that forms the flow paths, which results in a further reduction in size.

In addition, it is preferable that the first liquid discharge unit and the second liquid discharge unit be separate bodies of the case member, the liquid inlet of a first case member for the first liquid discharge unit and the liquid inlet of a second case member for the second liquid discharge unit be disposed at positions shifted from the center between the pressure generating chambers at both of the ends in the first direction, and the first case member and the second case member be a common member. In this case, it is possible to have the positions of the liquid inlets respectively corresponding to the first liquid discharge unit and the second liquid discharge unit do not overlap in the second direction without any increase in the number of components. As such, the gap between the rows of the nozzles can remain narrow and a sufficient thickness can be ensured for the flow path member that forms the flow paths, which results in a further reduction in size.

According to another aspect of the invention, there is provided a liquid ejecting apparatus that includes the liquid ejecting head described above.

In this aspect, the liquid ejecting apparatus can be realized that allows the gap between the rows of the nozzles to remain narrow, allows a sufficient thickness to be ensured for the flow path member that forms the flow paths which are connected to the liquid inlets of the first liquid discharge unit and the second liquid discharge unit, and includes the head which is compact in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to the accompanying drawings.

First Embodiment

Figure 1:
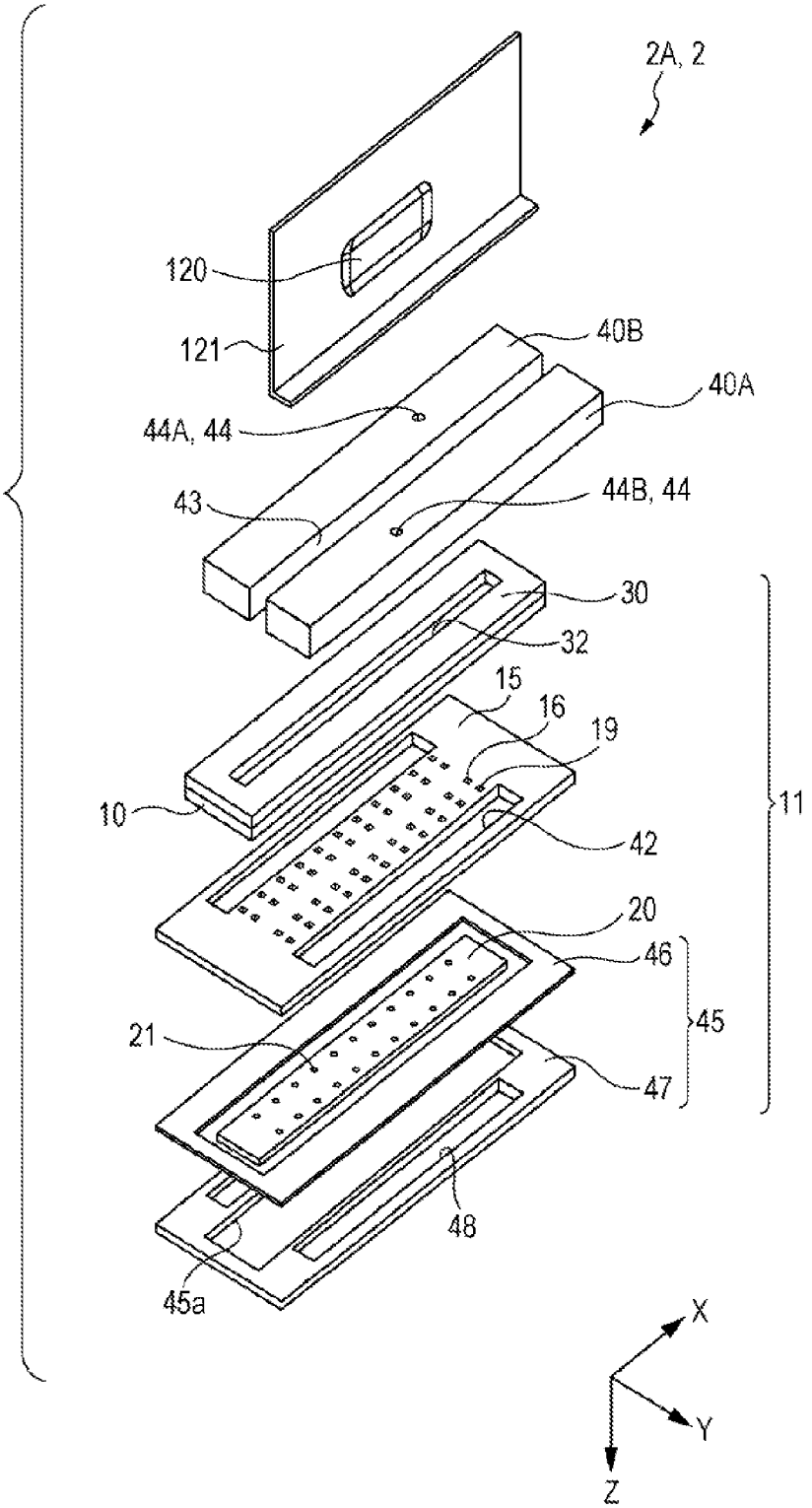
FIG. 1 is an exploded perspective view of first liquid discharge units according to a first embodiment of the invention.
Figure 2:
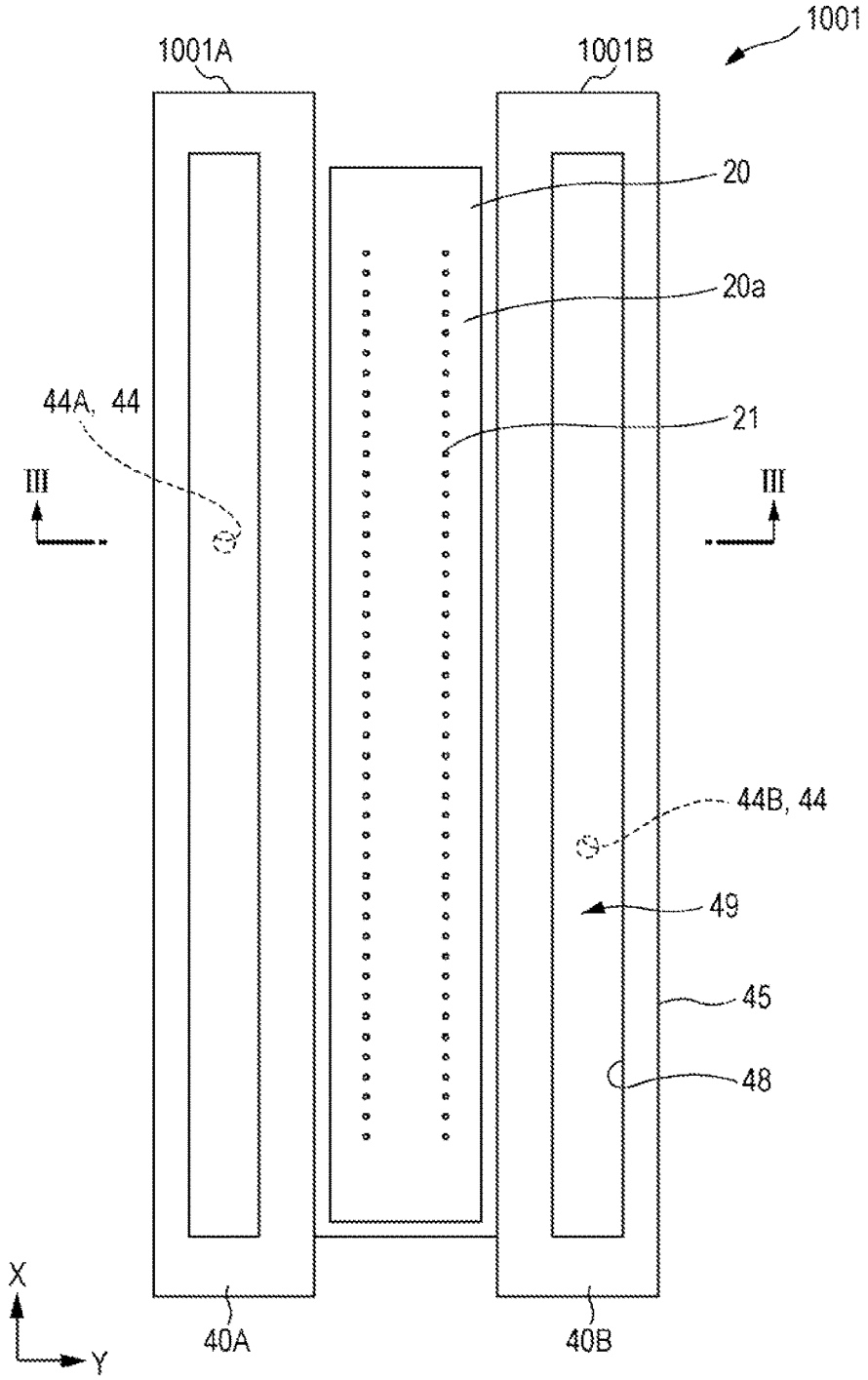
FIG. 2 is a plan view of the first liquid discharge units according to the first embodiment of the invention.
Figure 3:
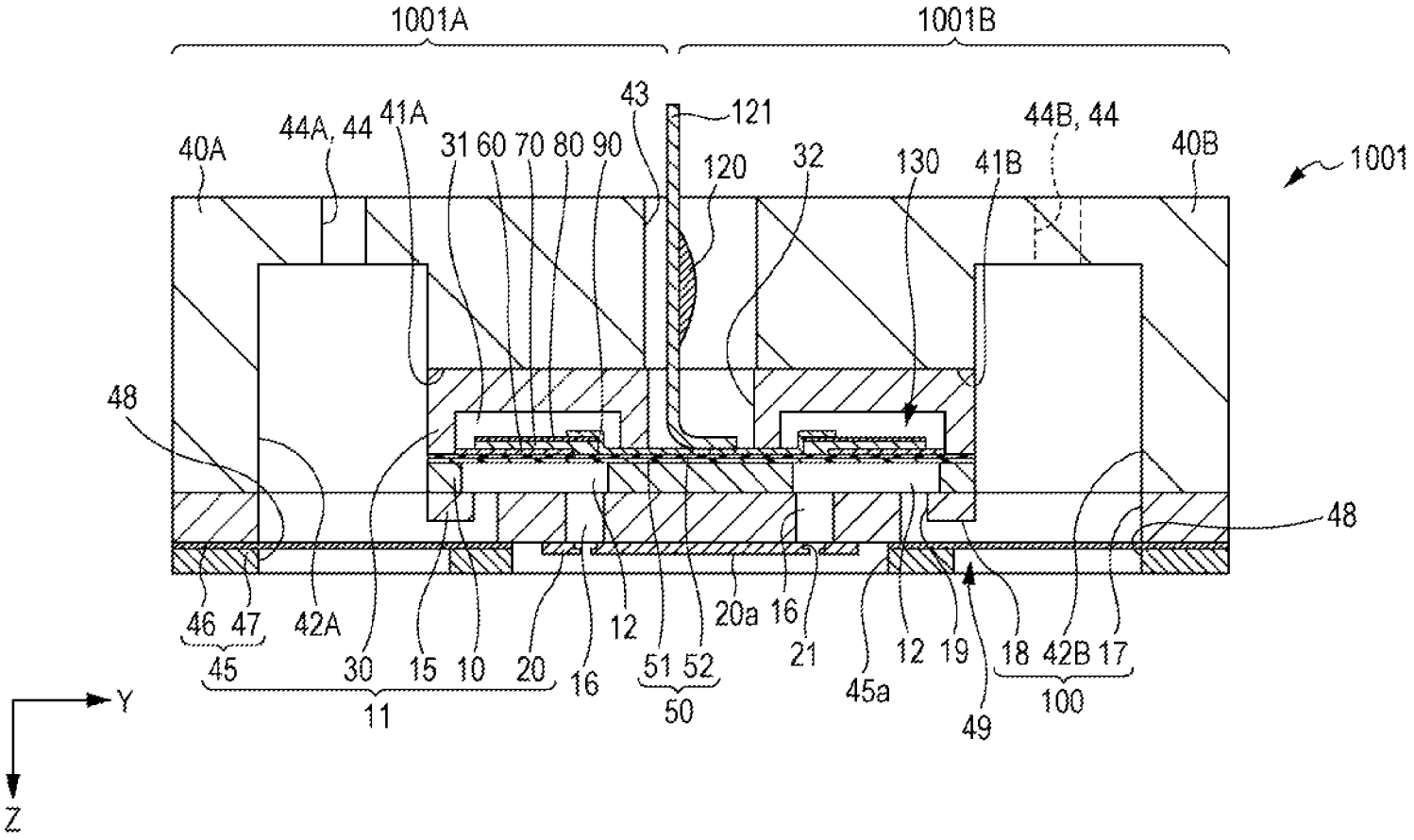
FIG. 3 is a sectional view of the first liquid discharge units according to the first embodiment of the invention.

Firstly, an example of liquid discharge units will be described with the units being disposed in an ink jet type recording head (hereinafter, simply referred to as a recording head) which is an example of a liquid ejecting head according to a first embodiment of the invention will be described. FIG. 1 is an exploded perspective view of first liquid discharge units according to the first embodiment of the invention. FIG. 2 is a plan view of the first liquid discharge units. FIG. 3 is a sectional view of the first liquid discharge units.

As illustrated in the drawings, the liquid discharge units according to this embodiment are first liquid discharge units 1001A and 1001B that are mounted on the ink jet type recording head which is an example of the liquid ejecting head. The two first liquid discharge units 1001A and 1001B constitute a liquid discharge unit pair 1001. The first liquid discharge units 1001A and 1001B include a plurality of members such as a head main body 11 and a case member 40 that is fixed to one surface side of the head main body 11. In addition, the head main body 11 according to this embodiment has a flow path forming substrate 10, a communicating plate 15 that is disposed on one surface side of the flow path forming substrate 10, a nozzle plate 20 that is disposed on the surface side of the communicating plate 15 opposite to the flow path forming substrate 10, a protective substrate 30 that is disposed on the side of the flow path forming substrate 10 opposite to the communicating plate 15, and a compliance substrate 45 that is disposed on the surface side of the communicating plate 15 where the nozzle plate 20 is disposed.

A metal such as stainless steel and Ni, a ceramic material typified by $ZrO_2$ or $Al_2O_3$, an oxide such as a glass ceramic material, Mgo, and $LaAlO_3$, and the like can be used in the flow path forming substrate 10 that constitutes the head main body 11. In this embodiment, the flow path forming substrate 10 is formed of a single crystal silicon substrate. A plurality of pressure generating chambers 12 that are partitioned by a partition wall are juxtaposed on the flow path forming substrate 10 through anisotropic etching from the one surface side. Hereinafter, this direction is referred to as a direction of juxtaposition of the pressure generating chambers 12, or a first direction X.

The one liquid discharge units 1001A and 1001B include one group of the plurality of pressure generating chambers 12 that are juxtaposed in a row. In addition, a plurality of rows (in which the pressure generating chambers 12 are juxtaposed in the first direction X to correspond to a plurality of units, two rows corresponding to the pair of liquid discharge units in this embodiment) are disposed on the flow path forming substrate 10. Hereinafter, an array direction (in which the plurality of rows of the pressure generating chambers 12, in which the pressure generating chambers 12 are formed in the first direction X, are disposed) is referred to as a second direction Y. Further, a direction that is orthogonal to the first direction X and the second direction Y is referred to as a direction of discharge of ink droplets (liquid droplets) or a third direction Z. The flow path forming substrate 10, the communicating plate 15, and the nozzle plate 20 are stacked in the third direction Z.

In addition, a supply path (which has a smaller opening area than the pressure generating chambers 12 and provides flow path resistance of ink which flows into the pressure generating chambers 12, and the like) may be disposed on one end portion sides of the pressure generating chambers 12 in the second direction Y on the flow path forming substrate 10.

In addition, the communicating plate 15 and the nozzle plate 20 are sequentially stacked on the one surface side of the flow path forming substrate 10. In other words, the communicating plate 15 (that is disposed on the one surface of the flow path forming substrate 10) and the nozzle plate 20 (that is disposed on the surface side of the communicating plate 15 opposite to the flow path forming substrate 10 and has nozzles 21) are provided.

Nozzle communicating paths 16 (which allow the pressure generating chambers 12 and the nozzles 21 to communicate with each other) are disposed in the communicating plate 15. The communicating plate 15 is larger in area than the flow path forming substrate 10, and the nozzle plate 20 is smaller in area than the flow path forming substrate 10. When the communicating plate 15 is disposed in this manner, the nozzles 21 of the nozzle plate 20 and the pressure generating chambers 12 are separated, and thus ink in the pressure generating chambers 12 is unlikely to be affected by thickening caused by the evaporation of moisture in ink occurring in ink in the vicinity of the nozzles 21. In addition, the nozzle plate 20 has only to cover openings of the nozzle communicating paths 16 that allow the pressure generating chambers 12 and the nozzles 21 to communicate with each other, and thus the area of the nozzle plate 20 can be relatively small with reduced costs. In this embodiment, a surface to which ink droplets are discharged with the nozzles 21 of the nozzle plate 20 open is referred to as a liquid ejecting surface 20*a*.

In addition, a first manifold portion 17 and a second manifold portion 18 (constituting a part of a manifold 100) are disposed on the communicating plate 15.

The first manifold portion 17 is disposed to penetrate the communicating plate 15 in a thickness direction (stacking direction of the communicating plate 15 and the flow path forming substrate 10).

In addition, the second manifold portion 18 is disposed to be open to the nozzle plate 20 side of the communicating plate 15, without penetrating the communicating plate 15 in the thickness direction.

Furthermore, in the communicating plate 15, supply communicating paths 19 (that communicate with the one end portions of the pressure generating chambers 12 in the second direction Y) are disposed independently in the respective pressure generating chambers 12. The supply communicating path 19 allows the second manifold portion 18 and the pressure generating chamber 12 to communicate with each other. In other words, in this embodiment, the supply communicating paths 19, the pressure generating chambers 12, and the nozzle communicating paths 16 are disposed as individual flow paths communicating with the nozzles 21 and the second manifold portions 18.

A metal such as stainless steel and nickel (Ni), ceramics such as zirconium (Zr), or the like can be used as the communicating plate 15. It is preferable that the communicating plate 15 employ a material having a linear expansion coefficient that is equal to that of the flow path forming substrate 10. In other words, in a case where a material that has a linear expansion coefficient that is significantly different from that of the flow path forming substrate 10 is used as the communicating plate 15, warping occurs through heating and cooling due to the difference between the linear expansion coefficient of the flow path forming substrate 10 and the linear expansion coefficient of the communicating plate 15. In this embodiment, the same material, that is, the single crystal silicon substrate is used as the communicating plate 15 as well as in the flow path forming substrate 10 and thus the warping caused by heat, cracks and peeling caused by heat, and the like can be suppressed.

The nozzles 21 (which communicate with the pressure generating chambers 12 via the nozzle communicating paths 16) are formed on the nozzle plate 20. In other words, the nozzles 21 that eject the same type of liquid (ink) are juxtaposed in the first direction X, and two rows of the nozzles 21 juxtaposed in the first direction X are formed in the second direction Y.

In other words, in this embodiment, a nozzle group that is disposed on the liquid ejecting surface 20*a* is a row of the nozzles juxtaposed in the first direction X in this embodiment. The row of the nozzles (nozzle group) is disposed in each of the first liquid discharge units 1001A and 1001B, and the number of the rows of the nozzles disposed in the second direction Y, which is a reference direction, in the liquid discharge unit pair 1001 is two. Herein, the nozzle group is not limited to the nozzle group that is juxtaposed linearly in the first direction X. For example, the nozzle group may be a nozzle group that is configured such that the nozzles 21 juxtaposed in the first direction X are alternately arranged at positions shifted in the second direction Y in a so-called zigzag arrangement. In addition, the nozzle group may be configured such that a plurality of the nozzles 21 juxtaposed in the first direction X are arranged in the second direction Y in a shifted manner. In other words, the nozzle group may be configured by using the plurality of nozzles 21 disposed on the liquid ejecting surface 20*a*, and the arrangement thereof is not particularly limited. However, in most cases, the direction in which the nozzles 21 are juxtaposed (first direction X) increases in length when the plurality of nozzles 21 (different nozzles) are arranged in high density. In other words, it is usual that the first direction X is a longitudinal direction and the second direction Y is a short direction in the liquid discharge unit pair 1001. In addition, the pressure generating chambers 12 are arranged to correspond to the nozzles 21 and pressure generating units (which generates pressure change in ink) are disposed to correspond to the pressure generating chambers 12, and thus the plurality of pressure generating chambers 12 and a plurality of piezoelectric actuators 130 (which are the pressure generating units) are juxtaposed in the first direction X. A wiring member (described in detail later), which supplies an electrical signal to the plurality of piezoelectric actuators 130 formed in high density, is connected to the piezoelectric actuators 130 by generating a space in a direction of juxtaposition of the piezoelectric actuators 130 on the substrate (that is, the first direction X (longitudinal direction)). Accordingly, the width of the sheet-shaped wiring member is arranged in the direction of juxtaposition of the piezoelectric actuators 130. In other words, when the width direction of the sheet-shaped wiring member is the direction of juxtaposition of the piezoelectric actuators 130, the connection between the piezoelectric actuators 130 and the wiring member can be performed smoothly even if the multiple piezoelectric actuators 130 are arranged in high density.

A metal such as stainless steel (SUS), an organic material such as a polyimide resin, a silicon single crystal substrate, or the like can be used as the nozzle plate 20. When a single crystal silicon substrate is used as the nozzle plate 20, warping caused by heating and cooling, cracks and peeling caused by heat, and the like can be suppressed since the linear expansion coefficients of the nozzle plate 20 and the communicating plate 15 are equal to each other.

A vibrating plate 50 is formed on the surface side of the flow path forming substrate 10 opposite to the communicating plate 15. In this embodiment, an elastic membrane 51 formed of silicon oxide (which is disposed on the flow path forming substrate 10 side) and an insulator film 52 formed of zirconium oxide (which is disposed on the elastic membrane 51) are disposed as the vibrating plate 50. A liquid flow path such as the pressure generating chambers 12 is formed through anisotropic etching of the flow path forming substrate 10 from the one surface side (surface side where the nozzle plate 20 is bonded), and the other surface of the liquid flow path such as the pressure generating chambers 12 are defined by the elastic membrane 51.

In addition, a first electrode 60, a piezoelectric layer 70, and a second electrode 80 are formed to be stacked on the insulator film 52 of the vibrating plate 50 and constitute the piezoelectric actuator 130. Herein, the piezoelectric actuator 130 refers to a part that has the first electrode 60, the piezoelectric layer 70, and the second electrode 80. In general, any one of the electrodes of the piezoelectric actuator 130 is a common electrode, and the other electrode and the piezoelectric layer 70 are configured through patterning in each of the pressure generating chambers 12. Herein, a part that is configured by any one of the electrodes that is patterned and the piezoelectric layer 70 and is subjected to piezoelectric distortion caused through voltage application to both of the electrodes is referred to as a piezoelectric active portion. In this embodiment, the first electrode 60 is the common electrode of the piezoelectric actuator 130 and the second electrode 80 is an individual electrode of the piezoelectric actuator 130. However, this may be reversed for the convenience of a drive circuit and wiring. In the example described above, the first electrode 60 is continuously disposed across the plurality of pressure generating chambers 12, and thus the first electrode 60 functions as a part of the vibrating plate. However, as an example and without being limited thereto, perhaps only the first electrode 60 may serve as the vibrating plate with the elastic membrane 51 and the insulator film 52 described above not disposed. In addition, the piezoelectric actuator 130 itself may serve practically as the vibrating plate. However, it is preferable that the first electrode 60 be protected by an insulating protective film or the like, so as to prevent conduction between the first electrode 60 and ink, in a case where the first electrode 60 is disposed directly on the flow path forming substrate 10. In other words, although an example in which the first electrode 60 is configured to be disposed on the substrate (flow path forming substrate 10) via the vibrating plate 50 is described in this embodiment, the first electrode 60 may be disposed directly on the substrate, without being limited thereto, with the vibrating plate 50 not disposed. In other words, the first electrode 60 may serve as the vibrating plate. In other words, to be on the substrate includes a state where another member is vertically interposed therebetween as well as to be directly on the substrate.

Furthermore, one end portions of lead electrodes 90 (which are drawn out of the vicinity of the end portions on the side opposite to the supply communicating paths 19, extend onto the vibrating plate 50, and are formed of gold (Au) or the like) are respectively connected to the second electrodes 80 that are the individual electrodes of the piezoelectric actuators 130. In addition, a wiring member 121 where a drive circuit 120 (described later) is disposed to drive the piezoelectric actuators 130 (which are the pressure generating units) is connected to the other end portions of the lead electrodes 90. A flexible sheet-shaped wiring member such as a COF substrate can be used as the wiring member 121. The drive circuit 120 may not be disposed in the wiring member 121. In other words, the wiring member 121 is not limited to the COF substrate, and may include FFC, FPC, and the like. In addition, the drive circuit 120 may not be disposed in the wiring member 121.

The other end portions of the lead electrodes 90 connected to the wiring member 121 are disposed to be juxtaposed in the first direction X. It is conceivable to extend the other end portions of the lead electrodes 90 to the one end portion side of the flow path forming substrate 10 in the first direction X and juxtapose the other end portions of the lead electrodes 90 in the second direction Y. However, this results in an increase in the size and costs of the recording head because a space is required for the lead electrodes 90 to be routed. In addition, the width of the lead electrodes decreases and electrical resistance increases when the multiple piezoelectric actuators 130 are disposed in high density to increase the number of the nozzles. Accordingly, the piezoelectric actuators 130 may not be in normal driving with the lead electrodes 90 routed and the electrical resistance further increased. In this embodiment, the other end portion sides of the lead electrodes 90 extend between the two rows of the piezoelectric actuators 130 juxtaposed in the first direction X and the other end portions of the lead electrodes 90 are juxtaposed in the first direction X so that the recording head 1 can be compact in size and lower in cost with no increase in size, an increase in electrical resistance can be suppressed in the lead electrodes 90, and the number of the nozzles can be increased with the multiple piezoelectric actuators 130 disposed in high density.

In addition, in this embodiment, the other end portions of the lead electrodes 90 are disposed between the rows of the piezoelectric actuators 130 in the second direction Y and the lead electrodes 90 and the wiring member 121 are connected with each other between the rows of the piezoelectric actuators 130, and thus the one wiring member 121 is connected to the two rows of the piezoelectric actuators 130 via the lead electrodes 90. The wiring member 121 is not limited thereto in number, and the wiring member 121 may be disposed in each of the rows of the piezoelectric actuators 130. When the one wiring member 121 is disposed with the two rows of the piezoelectric actuators 130 as in this embodiment, a space where the wiring member 121 and the lead electrode 90 are connected with each other can be narrow and the recording head 1 can be compact in size. In a case where the wiring member 121 is disposed in each of the rows of the piezoelectric actuators 130, it is also conceivable to extend the lead electrodes 90 to the side opposite the rows of the piezoelectric actuators 130. However, in such a configuration, an even wider space is required for the connection of the lead electrode with the wiring member and the number of the areas where the wiring member 121 is drawn out to the case member and the like becomes two, which results in the recording head 1 becoming larger in size. In other words, the two rows of the piezoelectric actuators 130 can be connected at the same time with the one wiring member 121 when the lead electrodes 90 are disposed between the two rows of the piezoelectric actuators 130 as in this embodiment. The width direction of the sheet-shaped wiring member 121, which is connected to the lead electrodes 90 in this manner, is arranged in the first direction X.

In addition, the protective substrate 30, which has substantially the same size as the flow path forming substrate 10, is bonded to the surface of the flow path forming substrate 10 on the sides toward the piezoelectric actuators 130, which are the pressure generating units. The protective substrate 30 has holding portions 31, which are spaces in which the piezoelectric actuators 130 are protected. The holding portions 31 are disposed independently in the respective rows configured with the piezoelectric actuators 130 juxtaposed in the first direction X, and a thickness-direction through-hole 32 is disposed between the two holding portions 31 (second direction Y). The other end portions of the lead electrodes 90 extended to be exposed into the through-hole 32, and the lead electrodes 90 and the wiring member 121 are electrically connected with each other in the through-hole 32.

In addition, the case member 40 (which defines the manifolds 100 communicating with the plurality of pressure generating chambers 12 along with the head main body 11) is fixed to the head main body 11 having this configuration. The case members 40A and 40B are respectively disposed in the liquid discharge units 1001A and 1001B. The pair of the case members 40A and 40B has substantially the same shape, in a plan view, as the communicating plate 15 described above, is bonded to the protective substrate 30, and is also bonded to the communicating plate 15 described above. Specifically, the case members 40A and 40B have concave portions 41A and 41B with a depth at which the flow path forming substrate 10 and the protective substrate 30 are accommodated to the protective substrate 30 side. The concave portions 41A and 41B have an opening area which is larger than that of the surface of the protective substrate 30 bonded to the flow path forming substrate 10. Opening surfaces of the concave portions 41A and 41B on the nozzle plate 20 side are sealed by the communicating plate 15 in a state where the flow path forming substrate 10 and the like are accommodated in the concave portions 41A and 41B. In this manner, a third manifold portion 42 (which holds the liquid by using the case members 40A and 40B and the head main body 11) is defined in an outer circumferential portion of the flow path forming substrate 10. The first manifold portion 17 and the second manifold portion 18 (that are disposed on the communicating plate 15) and the third manifold portion 42 (that is defined by the case members 40A and 40B and the head main body 11) constitute the manifold 100 of this embodiment. In other words, the manifold 100 has the first manifold portion 17, second manifold portion 18, and the third manifold portion 42. In addition, the manifolds 100 according to this embodiment are arranged on both outer sides of the two rows of the pressure generating chambers 12 in the second direction Y, and the two manifolds 100 that are disposed on both of the outer sides of the two rows of the pressure generating chambers 12 are disposed independently of each other so as not to communicate in the liquid discharge unit pair 1001. In other words, the manifolds 100 are disposed to communicate with the respective rows (rows juxtaposed in the first direction X) of the pressure generating chambers 12 of this embodiment. In other words, the manifold 100 is disposed for each of the nozzle groups. The two manifolds 100 may communicate with each other.

In addition, in the case members 40A and 40B, inlets 44A and 44B are respectively disposed to communicate with the manifolds 100 and supply ink to the respective manifolds 100. In this embodiment, the inlets 44A and 44B are disposed for the respective manifolds 100 corresponding respectively to the liquid discharge units 1001A and 1001B. In other words, provided are the first inlet 44A that communicates with one of the nozzle groups corresponding to the liquid discharge unit 1001A via one of the manifolds 100 and the second inlet 44B that communicates with the other one of the nozzle groups corresponding to the liquid discharge unit 1001B via the other one of the manifolds 100. The first inlet 44A and the second inlet 44B are collectively referred to as an inlet 44.

In addition, the case members 40A and 40B are arranged with a gap in-between, which communicates with the through-hole 32 of the protective substrate 30 for the wiring member 121 to be inserted. This gap is a connection port 43 that communicates with the through-hole 32. In other words, the first inlet 44A and the second inlet 44B are disposed on both sides of the connection port 43 (through-hole 32) in the second direction Y. In other words, one end portion of the wiring member 121 is connected to the piezoelectric actuators 130 (which are the pressure generating units) via the lead electrodes 90 between the first inlet 44A and the second inlet 44B in the second direction Y, which is the reference direction. The other end portion of the wiring member 121 extends in the direction opposite to the penetration directions of the through-hole 32 and the connection port 43 (that is, the third direction Z, which is the direction of discharge of ink droplets). In this embodiment, the case members 40A and 40B are separate members. However, both of the case members 40A and 40B may be integrated with each other with an opening disposed in the area into which the wiring member 121 is inserted.

Herein, the position of the first inlet 44A and the position of the second inlet 44B are shifted in the first direction X. Furthermore, the distance between the first inlet 44A and the second inlet 44B is longer than in a case where the position of the first inlet 44A and the position of the second inlet 44B are arranged not to be shifted in the first direction X. This distance is highly significant in designing a flow path substrate (described later). It is preferable that the distance be as long as possible for a flow path member (where flow paths communicating respectively with the first inlet 44A and the second inlet 44B of the case members 40A and 40B are arranged) to be ensured to have sufficient thickness, to be ensured to have sufficient mechanical strength, to be ensured to a have sufficient area for adhesion, and to be compact in size. When the first inlet 44A and the second inlet 44B are arranged at the centers of the case members 40A and 40B in the first direction X (longitudinal direction) to increase the distance, the gap between the rows of the nozzles in the second direction Y is widened and, as a result, the head is unlikely to be compact in size. As such, in this embodiment, the positions of the first inlet 44A and the second inlet 44B are shifted in the first direction X, not to overlap in the second direction Y, so that the gap between the rows of the nozzles remains narrow, the flow paths of the flow path member are ensured to have sufficient thickness, and the head is compact in size.

The positions of the first inlet 44A and the second inlet 44B are positions that are shifted in the respective reverse directions in the first direction X from the middle position between the pressure generating chambers 12 at both ends in the first direction X. However, the amount of the shift is not particularly limited. The first inlet 44A and the second inlet 44B may or may not have the same amount of shift, but it is preferable that the first inlet 44A and the second inlet 44B have the same amount of the shift. In a case where the first inlet 44A and the second inlet 44B have the same amount of the shift, the case member 40A and the case member 40B can be common members, and the same members can be used in an inverted manner as the case members 40A and 40B, which can lead to a reduced number of components.

Examples of the material that can be used in the case member 40 include resins and metals. When a resinous material is molded as the case member 40, mass production is available at a low cost.

In addition, a compliance substrate 45 is disposed on a surface of the communicating plate 15 where the first manifold portion 17 and the second manifold portion 18 are open. The compliance substrate 45 has substantially the same size, in a plan view, as the communicating plate 15 described above. A first exposing opening portion 45*a* that exposes the nozzle plate 20 is disposed in the compliance substrate 45. The openings of the first manifold portion 17 and the second manifold portion 18 on the liquid ejecting surface 20*a* side are sealed in a state where the compliance substrate 45 exposes the nozzle plate 20 by using the first exposing opening portion 45*a*.

In other words, the compliance substrate 45 defines a part of the manifold 100. The compliance substrate 45 has a sealing film 46 and a fixed substrate 47 in this embodiment. The sealing film 46 is formed of a flexible and film-shaped thin film (for example, a thin film with a thickness of 20 μm or less which is formed of polyphenylene sulfide (PPS) or the like), and the fixed substrate 47 is formed of a hard material such as a metal, examples of which include stainless steel (SUS). An area of the fixed substrate 47 facing the manifold 100 is an opening portion 48 that is completely removed in the thickness direction, and thus one surface of the manifold 100 is a compliance portion 49 that is a flexible portion which is sealed only by the flexible sealing film 46. In this embodiment, one compliance portion 49 is disposed to correspond to one manifold 100. In other words, in this embodiment, the number of the manifolds 100 disposed is two, and thus the number of the compliance portions 49 is two, which are disposed on both sides in the second direction Y across the nozzle plate 20.

When ink is ejected, ink is introduced via the inlet 44 and inner portions of the flow paths reaching the nozzles 21 from the manifolds 100 are filled with ink in the first liquid discharge units 1001A and 1001B having this configuration. Then, a voltage is applied to the respective piezoelectric actuators 130 (which correspond to the pressure generating chambers 12) according to a signal from the drive circuit 120 so that the vibrating plate 50 is subjected to a bending deformation along with the piezoelectric actuators 130. This results in an increase in the pressure in the pressure generating chambers 12, and ink droplets are ejected from the predetermined nozzles 21.

Figure 4:
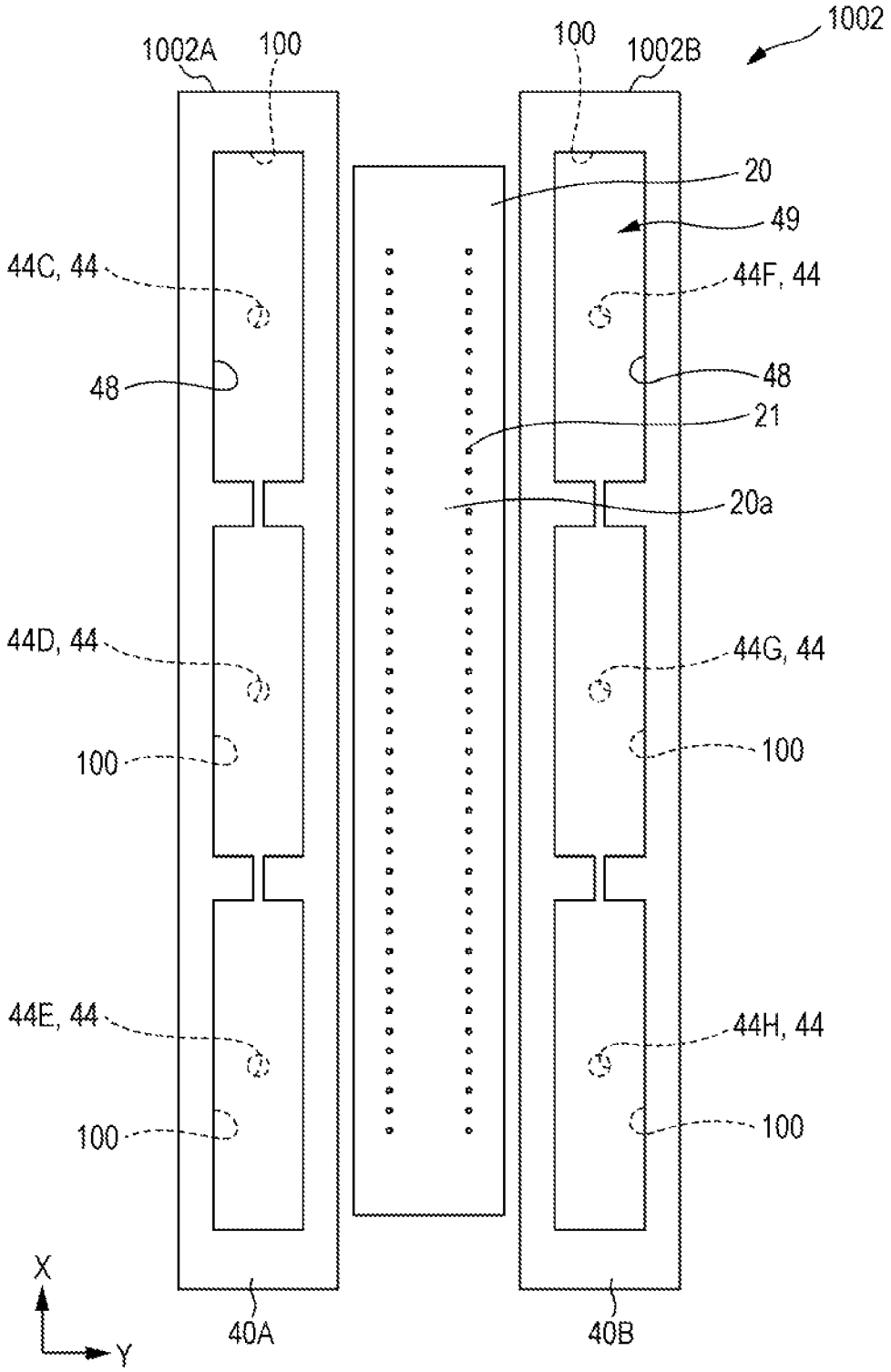
FIG. 4 is a plan view illustrating second liquid discharge units according to the first embodiment of the invention.

The first liquid discharge units 1001A and 1001B have been described as an example of the liquid discharge unit in this embodiment, but the invention is not particularly limited thereto. The recording head 1 according to this embodiment includes the first liquid discharge units 1001A and 1001B and second liquid discharge units 1002A and 1002B that have substantially the same structure as the first liquid discharge units 1001A and 1001B described above but with the manifolds 100 divided into three in the first direction X. Hereinafter, the first liquid discharge units 1001A and 1001B and the second liquid discharge units 1002A and 1002B are collectively referred to as a liquid discharge unit 1000. Herein, the second liquid discharge units 1002A and 1002B, which are mounted on the ink jet type recording head 1 according to this embodiment, will be described with reference to FIG. 4. FIG. 4 is a plan view illustrating the second liquid discharge units.

In the second liquid discharge units 1002A and 1002B, the manifolds 100 are disposed on both sides of the nozzles 21 in the second direction Y. In addition, the manifolds 100 that are disposed on both of the sides in the second direction Y are respectively divided into a plurality of the manifolds 100 in the first direction X, divided into three in this embodiment. As such, a total of six manifolds 100 are disposed in the second liquid discharge units 1002A and 1002B, three in each of the second liquid discharge units 1002A and 1002B. In addition, the compliance portion 49 (opening portion 48) is disposed in each of the partitioned manifolds 100. Furthermore, the inlet 44 is disposed in each of the manifolds 100. In other words, each of the second liquid discharge units 1002A and 1002B according to this embodiment has the row of the three manifolds 100 juxtaposed in the first direction X, and the two rows are disposed in the second direction Y in the liquid discharge unit pair 1002. The inlet 44 is disposed in a central portion of each of the manifolds 100 in the first direction X. Accordingly, the three inlets 44 of each of the liquid discharge units 1002A and 1002B (which are juxtaposed in the first direction X) form a row. In this embodiment, the inlet 44 that corresponds to the second liquid discharge unit 1002A is referred to as first inlets 44C, 44D and 44E, and the inlet 44 that corresponds to the second liquid discharge unit 1002B is referred to as second inlets 44F, 44G, and 44H. In other words, in the second liquid discharge units 1002A and 1002B of this embodiment, the positions of the first inlet 44C and the second inlet 44F in the second direction Y, the positions of the first inlet 44D and the second inlet 44G in the second direction Y, and the positions of the first inlet 44E and the second inlet 44H in the second direction Y are not shifted in the second direction Y but match each other to be positioned at the respective centers between the pressure generating chambers 12 at both of the ends in the first direction X.

The effect of the invention described above cannot be achieved by the liquid discharge unit pair 1002 alone, which is formed from the second liquid discharge units 1002A and 1002B. However, the effect described above can be achieved when the liquid discharge unit pair 1002 is used in combination with the liquid discharge unit pair 1001 formed from the first liquid discharge units 1001A and 1001B described above.

In other words, when the liquid discharge unit pair 1001 and the liquid discharge unit pair 1002 are arranged to be adjacent to each other as a liquid discharge head, the first liquid discharge unit 1001A and the second liquid discharge unit 1002B or the first liquid discharge unit 1001B and the second liquid discharge unit 1002A are arranged to be adjacent to each other. In a case where a common flow path member is designed by using the liquid discharge unit pair 1001 and the liquid discharge unit pair 1002, the positions of the first inlet 44A of the first liquid discharge unit 1001A and the second inlets 44F, 44G, and 44H of the second liquid discharge unit 1002B in the second direction Y or the positions of the second inlet 44B of the first liquid discharge unit 1001B and the first inlets 44C, 44D, and 44E of the second liquid discharge unit 1002A in the second direction Y do not overlap. Thus the same effect can be achieved as in the liquid discharge unit pair 1001 described above. This point will be described in detail later.

In the second liquid discharge units 1002A and 1002B, as in the first liquid discharge units 1001A and 1001B, the one end portion of the wiring member 121 (not illustrated) is connected to the piezoelectric actuators 130 (not illustrated), which are the pressure generating unit, via the lead electrodes 90 between the first inlets 44C to 44E and the second inlets 44F to 44H in the second direction Y, which is the reference direction. The other end portion of the wiring member 121 extends in the direction opposite to the penetration directions of the through-hole 32 and the connection port 43 (that is, the third direction Z, which is the direction of discharge of ink droplets). The basic configuration of the second liquid discharge units 1002A and 1002B is the same as that of the first liquid discharge units 1001A and 1001B and redundant description is omitted.

Figure 5:
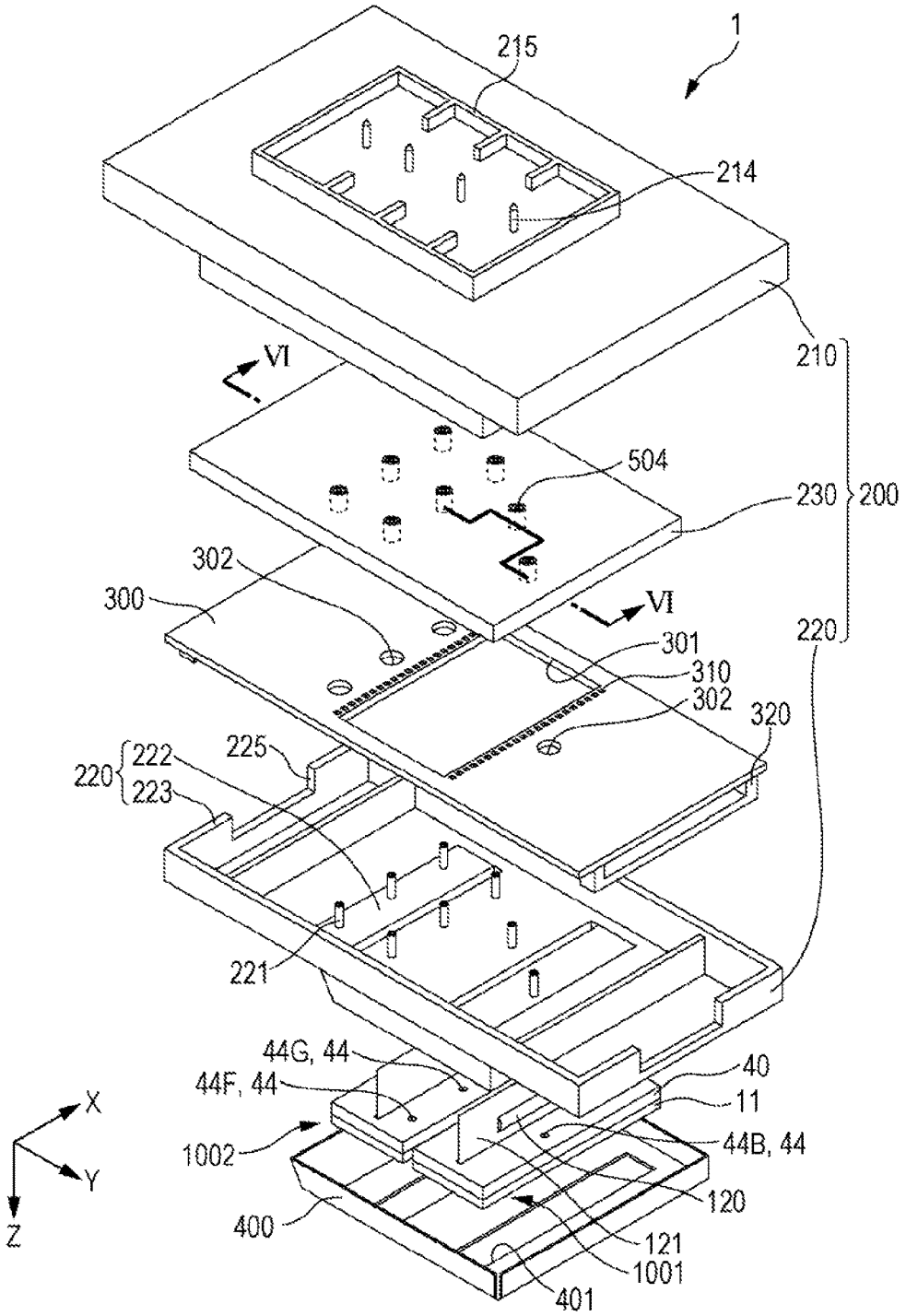
FIG. 5 is an exploded perspective view of an ink jet type recording head according to the first embodiment of the invention.
Figure 6:
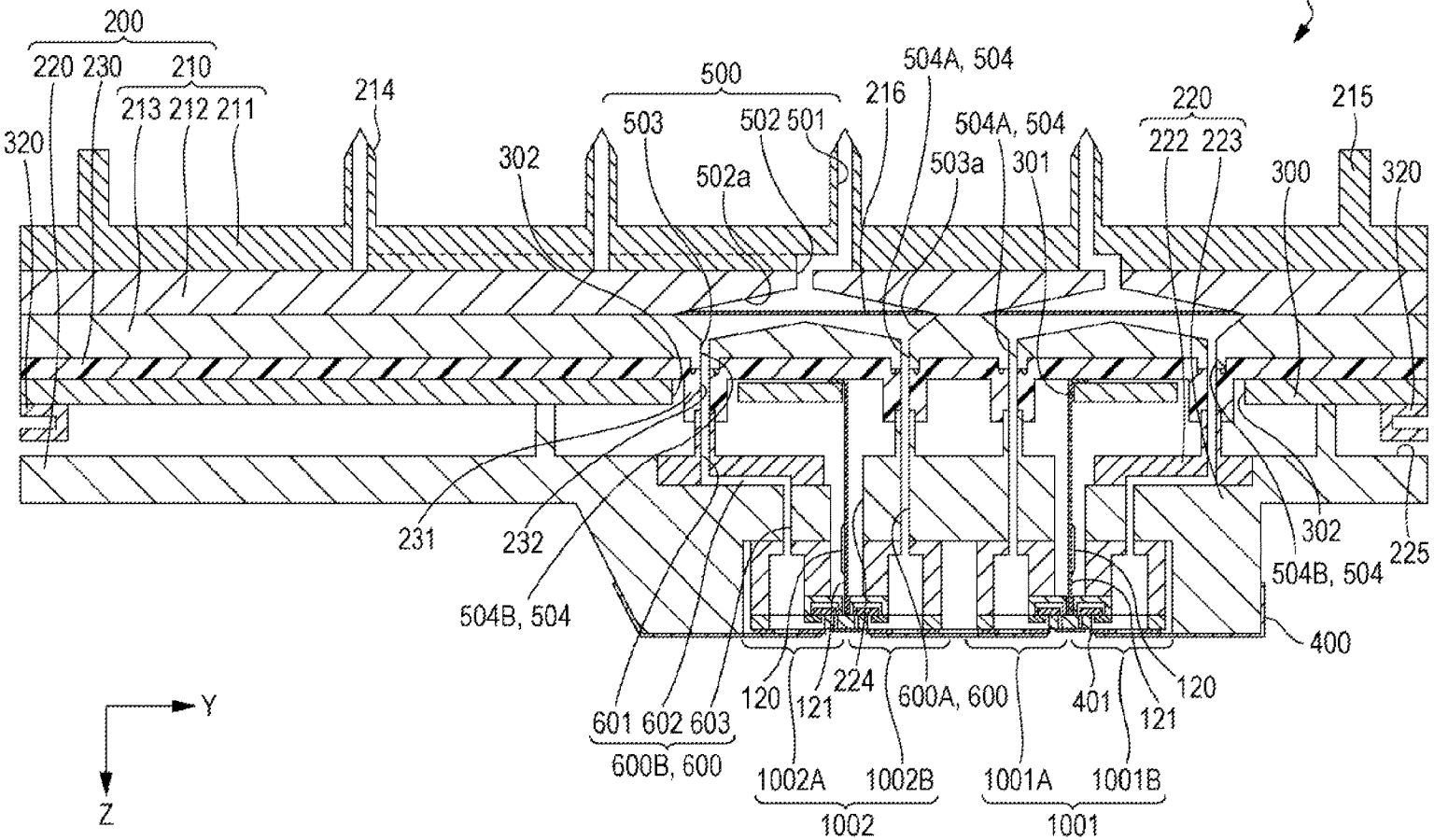
FIG. 6 is a sectional view of the ink jet type recording head taken along line XI-XI.
Figure 7:
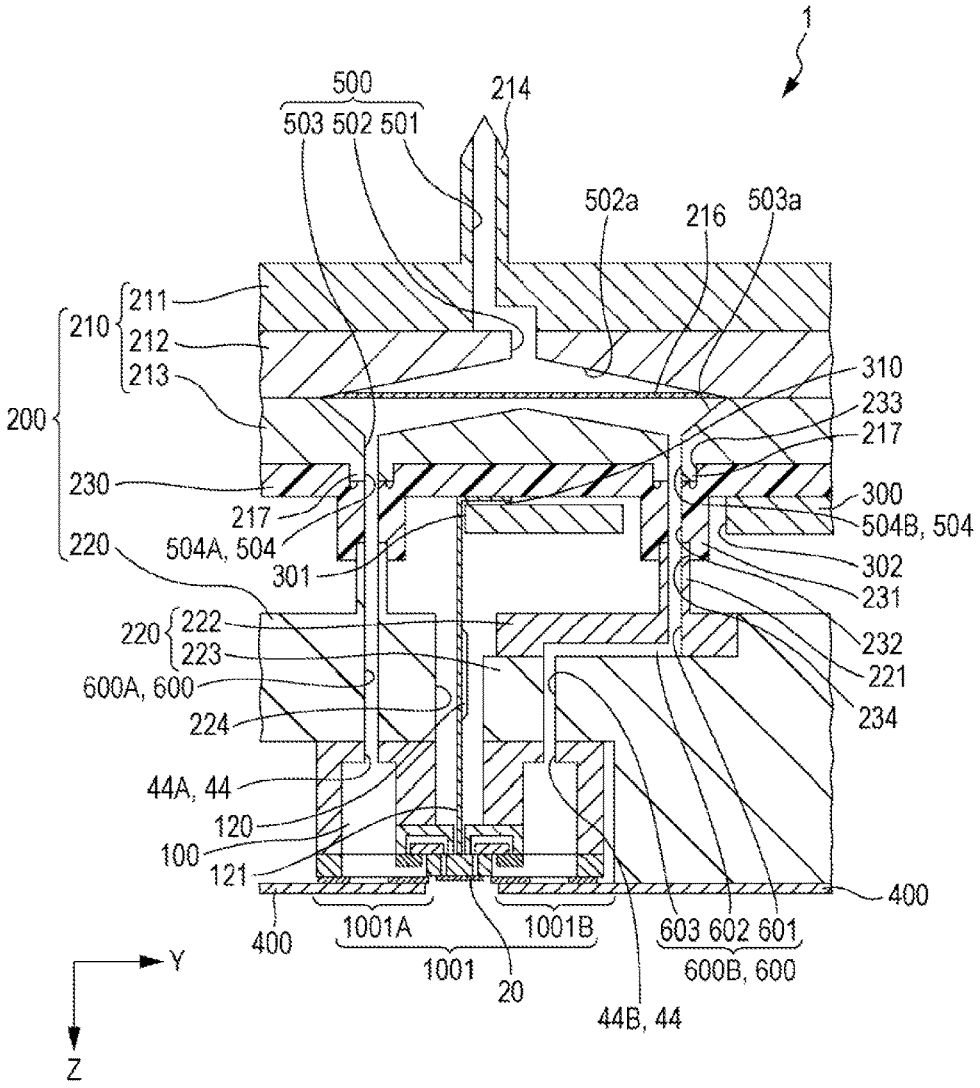
FIG. 7 is an enlarged sectional view of a main part of the ink jet type recording head.
Figure 8A:
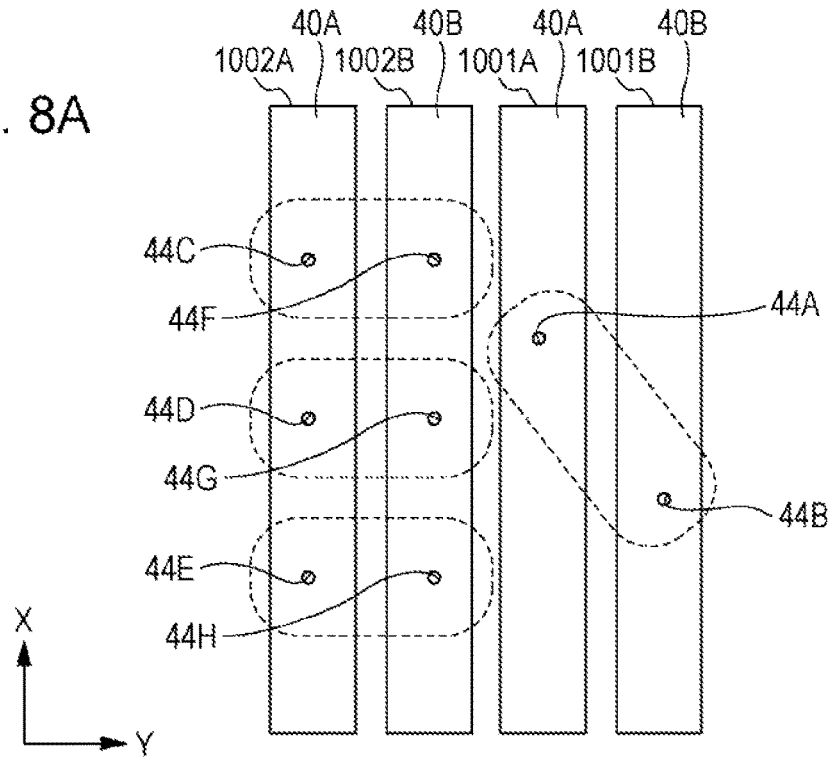
FIGS. 8A and 8B are schematic plan views illustrating an arrangement of an inlet of the ink jet type recording head.
Figure 8B:
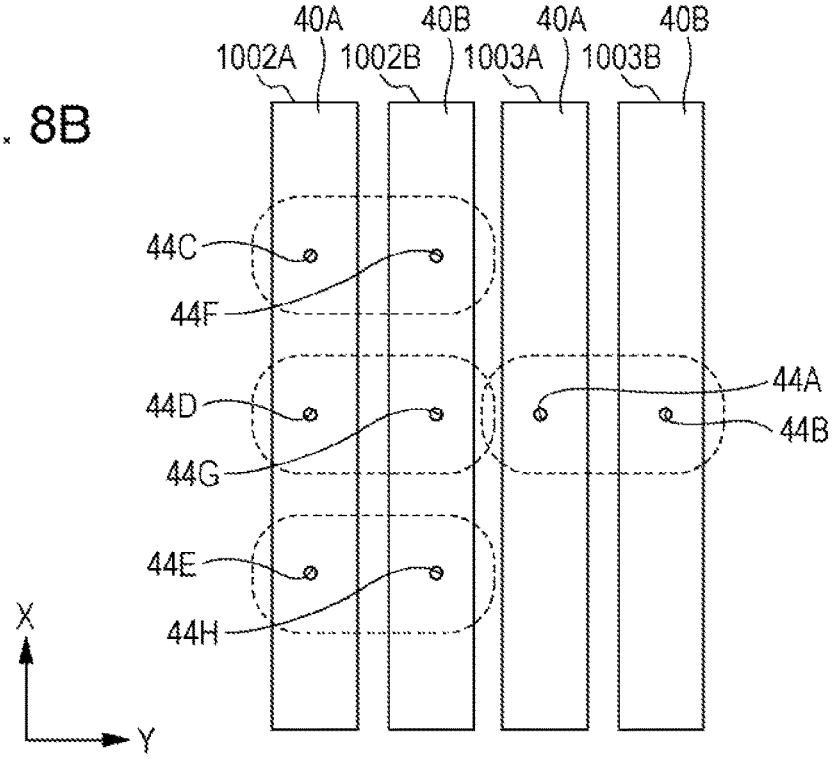

The ink jet type recording head (which is an example of the liquid ejecting head according to this embodiment) including the first liquid discharge units 1001A and 1001B and the second liquid discharge units 1002A and 1002B, will be described in detail. FIG. 5 is an exploded perspective view of the ink jet type recording head, which is an example of the liquid ejecting head according to the first embodiment of the invention. FIG. 6 is a sectional view of the ink jet type recording head taken along line XI-XI. FIG. 7 is an enlarged sectional view of a main part. FIGS. 8A and 8B are schematic plan views illustrating arrangements of the inlet.

As illustrated in the drawings, the recording head 1 includes the two liquid discharge unit pairs 1001 and 1002 (the first liquid discharge unit pair 1001 and the second liquid discharge unit pair 1002) that discharge ink (liquid) as ink droplets (liquid droplets) from the nozzle. The recording head further includes a flow path member 200 that holds the two liquid discharge unit pairs 1001 and 1002 and supplies ink (liquid) to the liquid discharge unit pairs 1001 and 1002, a wiring substrate 300 that is held by the flow path member 200, and cover heads 400 that are disposed on the liquid ejecting surface 20*a* sides of the liquid discharge units 1001A, 1001B, 1002A, and 1002B.

The flow path member 200 has an upstream flow path member 210 where an upstream flow path 500 is disposed, a downstream flow path member 220 where a downstream flow path 600 is disposed, and a seal member 230 that connect the upstream flow path 500 with the downstream flow path 600 in a sealed state.

In this embodiment, a first upstream flow path member 211, a second upstream flow path member 212, and a third upstream flow path member 213 are stacked in the third direction Z in which ink droplets are discharged (the direction orthogonal to the first direction X and the second direction Y) to constitute the upstream flow path member 210. However, the upstream flow path member 210 is not particularly limited thereto, and may be a single member or may be configured by using a plurality of, or two or more, members. In addition, a direction in which the plurality of members constituting the upstream flow path member 210 are stacked is not particularly limited, and may be the first direction X or the second direction Y as well.

The first upstream flow path member 211 has connection portions 214 (which are connected to a liquid holding portion such as an ink tank and an ink cartridge where ink (liquid) is held) on the surface side opposite to the downstream flow path member 220. In this embodiment, the connection portions 214 protrude in a needle shape. The liquid holding portion (such as the ink cartridge) may be directly connected to the connection portions 214, and the liquid holding portion (such as the ink tank) may be connected via a supply tube (such as a tube). First upstream flow paths 501 (to which ink is supplied from the liquid holding portion) are disposed in the connection portions 214. In addition, guide walls 215 are disposed around the connection portions 214 of the first upstream flow path member 211 so as to position the liquid holding portion. Flow paths that extend in the third direction Z to correspond to second upstream flow paths 502 (described later), flow paths that extend in planes including the directions orthogonal to the third direction Z (that is, the first direction X and the second direction Y to correspond to second upstream flow paths 502), and the like constitute the first upstream flow paths 501.

The second upstream flow path member 212 is fixed to the surface side of the first upstream flow path member 211 opposite to the connection portions 214 and has the second upstream flow paths 502 which communicate with the first upstream flow paths 501. In addition, first liquid reservoir portions 502*a* (which are widened to be larger in inner diameter than the first upstream flow paths 501) are disposed on the downstream side (third upstream flow path member 213 side) of the second upstream flow paths 502.

The third upstream flow path member 213 is disposed on the side of the second upstream flow path member 212 opposite to the first upstream flow path member 211. In addition, third upstream flow paths 503 are disposed in the third upstream flow path member 213. Opening parts of the third upstream flow paths 503 on the second upstream flow path 502 side are second liquid reservoir portions 503*a*, which are widened to correspond to the first liquid reservoir portions 502*a*, and filters 216 are disposed at opening parts (between the first liquid reservoir portions 502*a* and the second liquid reservoir portions 503*a*) of the second liquid reservoir portions 503*a* so as to remove bubbles and foreign substances contained in ink. As such, ink that is supplied from the second upstream flow paths 502 (first liquid reservoir portions 502*a*) is supplied to the third upstream flow paths 503 (second liquid reservoir portions 503*a*) via the filters 216.

In addition, the third upstream flow path 503 branches into two on the further downstream side (the side opposite to the second upstream flow path) than the second liquid reservoir portion 503*a*, and the third upstream flow path 503 is disposed to be open (as a first outlet 504A and a second outlet 504B) on the surface of the third upstream flow path member 213 on the downstream flow path member 220 side.

In other words, the upstream flow path 500 that corresponds to one of the connection portions 214 has the first upstream flow path 501, the second upstream flow path 502, and the third upstream flow path 503. Furthermore, the upstream flow path 500 is open as the two outlets 504 (the first outlet 504A and the second outlet 504B) on the downstream flow path member 220 side. In other words, the two outlets 504 (the first outlet 504A and the second outlet 504B) are disposed to communicate with the common flow path.

In addition, first protruding portions 217 (which protrude toward the downstream flow path member 220 side) are disposed on the downstream flow path member 220 side of the third upstream flow path member 213. The first protruding portion 217 is disposed in each of the branching third upstream flow paths 503, and the outlets 504 are disposed to be open at respective tip end surfaces of the first protruding portions 217.

The first upstream flow path member 211, the second upstream flow path member 212, and the third upstream flow path member 213 (where the upstream flow paths 500 are formed in this manner) are integrally stacked by using, for example, an adhesive, welding, and the like. The first upstream flow path member 211, the second upstream flow path member 212, and the third upstream flow path member 213 can also be fixed by using a screw, a clamp, and the like. However, it is preferable that bonding be performed by using an adhesive, welding, and the like so as to suppress the leakage of ink (liquid) from connection parts reaching the third upstream flow paths 503 from the first upstream flow paths 501.

In this embodiment, four connection portions 214 are disposed in one upstream flow path member 210 and four independent upstream flow paths 500 are disposed in one upstream flow path member 210. Since each of the upstream flow paths 500 branches into two on the downstream flow path member 220 side, the total number of the outlets 504 disposed is eight. A configuration in which the upstream flow path 500 branches into two further downstream (downstream flow path member 220 side) than the filter 216 has been illustrated as an example in this embodiment. However, the invention is not limited thereto, and the upstream flow path 500 may branch into three or more on the further downstream side than the filter 216. In addition, the one upstream flow path 500 may not branch further downstream than the filter 216.

The downstream flow path member 220 has the downstream flow path 600 that is connected to the upstream flow path 500. A second protruding portion 221, which protrudes to the upstream flow path member 210 side, is disposed in the downstream flow path member 220. The second protruding portion 221, which corresponds to the first protruding portion 217, is disposed in each of the upstream flow paths 500 (that is, in each of the first protruding portions 217). In addition, one end of the downstream flow path 600 is disposed to be open to a tip end surface of the second protruding portion 221, and the other end of the downstream flow path 600 is disposed to be open to the surface on the side opposite to the upstream flow path member 210 in the third direction Z. In this embodiment, the downstream flow path 600 corresponds to the connection flow path described in the scope of the claims. The downstream flow path 600 is disposed independently at each of the outlets 504 of the respective upstream flow paths 500. In other words, one upstream flow path 500 has two first outlet 504A and second outlet 504B, and thus the downstream flow path 600 connected to the first outlet 504A is a first connection flow path 600A and the downstream flow path 600 connected to the second outlet 504B is a second connection flow path 600B. Hereinafter, the first connection flow path 600A and the second connection flow path 600B are collectively referred to as the connection flow path 600.

In addition, the plurality of liquid discharge unit pairs, the two liquid discharge unit pairs 1001 and 1002 in this embodiment, are fixed to the surface side of the downstream flow path member 220 opposite to the upstream flow path member 210. Herein, the one liquid discharge unit pair 1001 and 1002 respectively have the liquid discharge units 1001A and 1001B and the liquid discharge units 1002A and 1002B, the nozzle groups (row of the nozzles) are formed to be juxtaposed in the second direction Y as described above, and the two liquid discharge unit pairs 1001 and 1002 are disposed to be juxtaposed in the second direction Y in the recording head 1. Hereinafter, the first direction X, the second direction Y, and the third direction Z of the liquid discharge unit pairs 1001 and 1002 respectively illustrate the same directions as the first direction X, the second direction Y, and the third direction Z of the recording head 1. The two liquid discharge unit pairs 1001 and 1002 that are disposed in the recording head 1 according to this embodiment are formed from the first liquid discharge unit pair 1001 and the second liquid discharge unit pair 1002 as described above. Two inlets 44 (one first inlet 44A and one second inlet 44B) are disposed in the first liquid discharge unit pair 1001, and six inlets 44 (first inlets 44C to 44E and second inlets 44F to 44H) are disposed in the second liquid discharge unit pair 1002. The downstream flow path 600 (the first connection flow path 600A and the second connection flow path 600B) that is disposed in the downstream flow path member 220 is disposed to be open to match the position where each of the inlets 44 is open.

Herein, in this embodiment, the first liquid discharge unit pair 1001 is arranged such that the first inlet 44A is on the second liquid discharge unit pair 1002 side in the second direction Y. Likewise, the second liquid discharge unit pair 1002 is arranged such that the first inlets 44C to 44E are on the first liquid discharge unit pair 1001 side in the second direction Y. The first connection flow path 600A that is the downstream flow path 600 connects the first outlet 504A with the first inlets 44A and 44F to 44H, and the second connection flow path 600B connects the second outlet 504B with the second inlets 44B and 44C to 44E. Accordingly, the first connection flow path 600A that connects the flow path of the first liquid discharge unit 1001A is arranged on the further second liquid discharge unit pair 1002 side than the second connection flow path 600B. Likewise, the first connection flow path 600A that connects the flow path of the second liquid discharge unit pair 1002 is arranged on the further first liquid discharge unit pair 1001 side than the second connection flow path 600B.

In this embodiment, the first connection flow path 600A is formed in a linear shape in the third direction Z. In addition, the second connection flow path 600B has an extending flow path that extends from the second inlet 44B toward the second direction Y which is the reference direction separated from the first inlet 44A. Specifically, the second connection flow path 600B has a first flow path 601 that is connected to the upstream flow path 500 (second outlet 504B), a second flow path 602 that is an extending flow path which is connected to the first flow path 601, and a third flow path 603 that connects the second flow path 602 and the second inlet 44B with each other.

The first flow path 601 and the third flow path 603 are disposed in a linear shape in the third direction Z. The first flow path 601 and the third flow path 603 may be disposed in the direction intersecting with the third direction Z as well.

In addition, the second flow path 602 (which is an extending flow path) extends toward the second direction Y. Herein, the extension of the second flow path 602 (extending flow path) toward the second direction Y means that a component (vector) toward the second direction Y is present in the direction of extension of the second flow path 602. The direction of extension of the second flow path 602 is the direction in which ink (liquid) in the second flow path 602 flows. Accordingly, the second flow path 602 includes those disposed in the horizontal direction (direction orthogonal to the third direction Z) and those disposed to intersect with the third direction Z and the horizontal direction (in-plane direction of the first direction X and the second direction Y). In this embodiment, the first flow path 601 and the third flow path 603 are disposed in the third direction Z and the second flow path 602 is disposed in the horizontal direction (second direction Y).

The second connection flow path 600B is not limited thereto, and a flow path other than the first flow path 601, the second flow path 602, and the third flow path 603 may also be present, and the first flow path 601 or the third flow path 603 may not be disposed. In addition, a configuration in which only the second flow path 602 is the extending flow path has been described in the example described above, but, without being limited thereto, two flow paths that have components in the second direction Y may also be extending flow paths. However, it is preferable that the number of the extending flow paths disposed be only one (only the second flow path 602) as in this embodiment, rather than two, because bubbles are likely to remain. In this case, bubble dischargeability can be improved. In addition, the second connection flow path 600B (which extends in a linear shape) may be disposed to be inclined at an angle to the third direction Z. In other words, the entire second connection flow path 600B may be the extending flow path. However, a space exclusive to the second connection flow path 600B can be saved and the recording head 1 can be compact in size when the vertical first flow path 601, the vertical third flow path 603, and the horizontal second flow path 602 are disposed.

When the second flow path 602 (which is an extending flow path) is disposed in the second connection flow path 600B in this manner, a gap in the second direction Y between an area where the first connection flow path 600A and the first outlet 504A communicate with each other and an area where the second connection flow path 600B and the second outlet 504B communicate with each other can be wider than a gap between the first inlets 44A and 44C to 44E and the second inlets 44B and 44F to 44H, without widening a gap in the second direction Y between the first inlets 44A and 44C to 44E and the second inlets 44B and 44F to 44H of the liquid discharge unit pairs 1001 and 1002.

In this manner, the wiring member 121 and the wiring substrate 300 can be connected with ease between the first connection flow path 600A and the second connection flow path 600B, with no increase in the size of the liquid discharge unit pairs 1001 and 1002.

In addition, the distance (second direction Y) between the first outlet 504A and the second outlet 504B can be increased when the second flow path 602 (which is an extending flow path) is disposed in the second connection flow path 600B. As such, a large area of the filter 216 (the first liquid reservoir portion 502*a* and the second liquid reservoir portion 503*a*), which is the common flow path, can be ensured. Herein, flow path resistance increases since the filter 216 is disposed, and thus the filter 216 is required to have a certain degree of size to ensure a flow rate. However, the area where the filter 216 (which is the common flow path allowing the first inlet 44A and the second inlet 44B to communicate) is disposed decreases in a case where the first inlet 44A and the second inlet 44B are close to each other due to a decrease in the size of a head chip 2 and the extending flow path is not disposed in the second connection flow path 600B. In other words, the area where the filter 216 is disposed can also be ensured with ease and the disadvantage described above can be addressed in a case where the head chip 2 is large and the distance between the first inlet 44A and the second inlet 44B is long (manifolds 100 far from each other) (that is, in a case where the positions of the first inlet 44A and the second inlet 44B are shifted in the first direction X and do not overlap in the second direction Y).

The seal member 230 (which is a joint connecting (linking) the upstream flow paths 500 and the downstream flow paths 600 with each other) is disposed between the upstream flow path member 210 and the downstream flow path member 220.

The seal member 230 has liquid resistance to a liquid, such as ink, used in the recording head 1 and an elastically deformable material (elastic material), such as rubber and an elastomer, can be used in the seal member 230. The seal member 230 has a tube-shaped part 231 in each of the downstream flow paths 600. A communicating flow path 232 is disposed in the tube-shaped part 231. The upstream flow path of the upstream flow path member 210 and the downstream flow path of the downstream flow path member 220 communicate with each other via the communicating flow path 232 of the tube-shaped part 231. An annular-shaped first concave portion 233 (into which the first protruding portion 217 is inserted) is disposed in an end surface of the tube-shaped part 231 on the upstream flow path member 210 side. In addition, a second concave portion 234 (into which the second protruding portion 221 is inserted) is disposed in an end surface of the tube-shaped part 231 on the downstream flow path member 220 side. The tube-shaped part 231 is held, in a state where a predetermined pressure is applied in the third direction Z, between the tip end surface of the first protruding portion 217 inserted into the first concave portion 233 and the tip end surface of the second protruding portion 221 inserted into the second concave portion 234. In this manner, the upstream flow path 500 and the communicating flow path 232 are connected in a state where pressure is applied in the third direction Z to the seal member 230, and the communicating flow path 232 and the downstream flow path 600 are connected in a state where pressure is applied in the third direction Z to the seal member 230. Accordingly, the upstream flow path 500 and the downstream flow path 600 communicate in a state where the upstream flow path 500 and the downstream flow path 600 are sealed via the communicating flow path 232.

A plurality of the tube-shaped parts 231 according to this embodiment are connected on the upstream flow path member 210 side, by a plate-shaped part, so that the plurality of tube-shaped parts 231 are integrated with respect to the one upstream flow path member 210. In this embodiment, the eight outlets 504 of the upstream flow path 500 are disposed in the one upstream flow path member 210, and thus the eight tube-shaped parts 231 are integrally disposed in the seal member 230.

In addition, in this embodiment, pressure is applied in the third direction Z to the seal member 230 to connect the upstream flow path 500 and the downstream flow path 600 with each other. However, the invention is not limited thereto. For example, the flow paths may be connected by bringing an inner wall surface of the tube-shaped part 231 and an outer circumferential surface of at least one of the first protruding portion 217 and the second protruding portion 221 into close contact with each other (that is, by applying pressure in the plane direction of the first direction X which is a radial direction and the second direction Y).

In addition, the wiring substrate 300 (to which the wiring member 121 is connected) is disposed between the seal member 230 and the downstream flow path member 220. Insertion holes (into which the wiring member 121 and the tube-shaped part 231 of the seal member 230 are inserted) are disposed in the wiring substrate 300. Disposed in this embodiment are a first insertion hole 301 (which is an opening portion where the tube-shaped part 231 disposed to correspond to the first connection flow path 600A and the wiring member 121 are inserted), and a second insertion hole 302 (which is an opening portion where the tube-shaped part 231 disposed to correspond to the second connection flow path 600B is inserted).

The first insertion hole 301 according to this embodiment is formed to have a size at which two wiring members 121 are allowed to be inserted. The four first connection flow paths 600A of the two liquid discharge unit pairs 1001 and 1002 are disposed between the two wiring members 121, and thus the tube-shaped part 231 of the seal member 230 which corresponds to the first connection flow path 600A is inserted into the first insertion hole 301 with the wiring member 121.

In addition, the second insertion hole 302 is disposed at each of the tube-shaped parts 231 disposed to correspond to the second connection flow path 600B. In other words, the wiring substrate 300 is arranged (on the side opposite to the first inlet 44A from the second flow path 602 which is the extending flow path of the second connection flow path 600B in the third direction Z) to extend in the second direction Y beyond the second connection flow path 600B from a facing area between the first connection flow path 600A and the second connection flow path 600B. In this embodiment, one wiring substrate 300 that is common to the two liquid discharge unit pairs 1001 and 1002 is disposed. Accordingly, the wiring substrate 300 extends in the second direction Y from the side of the second connection flow path 600B (which is disposed for the first liquid discharge unit pair 1001, opposite to the first connection flow path 600A) to the side of the second connection flow path 600B for the second liquid discharge unit pair 1002 opposite to the first connection flow path 600A through the facing area between the first connection flow path 600A for the first liquid discharge unit pair 1001 and the first connection flow path 600A for the second liquid discharge unit pair 1002. The wiring substrate 300 is not limited thereto and may be disposed, in a divided manner, in each of the liquid discharge unit pairs 1001 and 1002. Even in this case, the wiring substrate 300 that is disposed in each of the liquid discharge unit pairs 1001 and 1002 is arranged to extend in the second direction Y beyond the second connection flow path 600B from the facing area between the first connection flow path 600A and the second connection flow path 600B, and thus the wiring member 121 and the wiring substrate 300 can be connected with ease. When the one common wiring substrate 300 is used in the two head chips 2 as in this embodiment, the number of components can be reduced and the assembly operation can be simplified.

In addition, the first insertion hole 301 can be disposed with a wider opening area when the two wiring members 121 and the two first connection flow paths 600A are inserted into the first insertion hole 301, which is one of opening portions of the wiring substrate 300, than in a case where a plurality of the opening portions are disposed. As such, the wiring member 121 can be drawn out with ease from the first insertion hole 301 and ease of assembly can be improved. In other words, the wiring member 121 has to be drawn out from the head chip 2 side of the wiring substrate 300 to the upstream flow path member 210 side so that the wiring member 121 and the wiring substrate 300 are connected to each other, it is difficult to insert the wiring substrate 300, which has flexibility, into a narrow opening.

In addition, the wiring member 121 that is inserted into the one first insertion hole 301, which is one of the opening portions of the wiring substrate 300, is in an upright state in the third direction Z and the two first connection flow paths 600A, which are inserted into the first insertion hole 301, are disposed in a linear shape in the third direction Z. As such, the opening area of the first insertion hole 301 can be as small as possible.

In addition, on the upstream flow path member 210 side surface of the wiring substrate 300, terminal portions 310 (to which the wiring member 121 is connected) are disposed in open edge portions on both sides of the first insertion hole 301 in the second direction Y. The terminal portions 310 are formed over a width that is substantially equal to the width of the wiring member 121 in the first direction X. The terminal portion 310 is formed not beyond the second insertion hole 302 to which the tube-shaped part 231 (which is disposed to correspond to the second connection flow path 600B) is inserted. In other words, the terminal portion 310 is disposed between the first connection flow path 600A (first insertion hole 301) and the second connection flow path 600B (second insertion hole 302).

The other end portion of the wiring member 121 is inserted into the first insertion hole 301 of the wiring substrate 300 from the downstream flow path member 220 side. The other end portion of the wiring member 121 that is inserted into the first insertion hole 301 in this manner is bent in the second direction Y on the surface (surface on the upstream flow path member 210 side) of the wiring substrate 300 and is connected to the terminal portions 310 on the surface of the wiring substrate 300 on the upstream flow path member 210 side. In other words, the surface of the connection between the wiring member 121 and the wiring substrate 300 (terminal portions 310) is in the in-plane direction of the first direction X and the second direction Y. A direction in which the wiring member 121 is bent in the second direction Y which is separated from the first inlet 44A in this embodiment. In other words, the other end portion of the wiring member 121 and the wiring substrate 300 are connected between the first connection flow path 600A and the second connection flow path 600B (second direction Y).

The area where the wiring member 121 and the wiring substrate 300 are connected in this manner can be ensured when the second flow path 602 (which is an extending flow path) is disposed in the second connection flow path 600B. In other words, in a case where the second connection flow path 600B is formed on a straight line in the third direction Z, the gap in the second direction Y between the first connection flow path 600A and the second connection flow path 600B is narrowed and the terminal portions 310 cannot be disposed. In addition, even if the terminal portions 310 can be disposed, a space is required for the wiring member 121 to be bent and connected and the wiring member 121 and the terminal portions 310 cannot be connected appropriately. In addition, the sizes of the liquid discharge unit pairs 1001 and 1002 increase and the size of the recording head 1 increases when the gap in the second direction Y between the first inlets 44A and the second inlets 44B of the liquid discharge unit pairs 1001 and 1002 is widened so that the terminal portions 310 are disposed. In this embodiment, the second flow path 602 that is an extending flow path is disposed in the second connection flow path 600B, and thus the wiring member 121 and the wiring substrate 300 can be connected between the first connection flow path 600A and the second connection flow path 600B without widening the gap between the respective case members 40A and 40B of the liquid discharge unit pairs 1001 and 1002. In addition, since the wiring substrate 300 is disposed between the first connection flow path 600A and the second connection flow path 600B, the wiring member 121 does not have to be drawn outside from between the first connection flow path 600A and the second connection flow path 600B, and disconnection or the like (which is attributable to excessive bending of the sheet-shaped wiring member 121) can be suppressed.

Furthermore, in this embodiment, the second connection flow paths 600B of the two liquid discharge unit pairs 1001 and 1002 are arranged on an outer side in the second direction Y. Thus the gap in the second direction Y between the two liquid discharge unit pairs 1001 and 1002 can be narrowed and the recording head 1 can be compact in size.

Wiring (not illustrated), electronic components (not illustrated), and the like are mounted on the wiring substrate 300. The wiring that is connected to the terminal portions 310 is connected to connectors 320 that are disposed on both end portion sides in the second direction Y. External wiring (not illustrated) is connected to the connectors 320. A connector connection port 222 that exposes the connectors 320 is disposed in the downstream flow path member 220. The external wiring is connected to the connectors 320 that are exposed by the connector connection port 222.

In a case where the wiring substrate 300 is disposed in the flow path member 200 in this manner, the wiring is subjected to a short circuit when the wiring substrate 300 comes into contact with ink, and thus it is necessary to suppress the leakage of ink (liquid) particularly from the connection part between the upstream flow path 500 and the downstream flow path 600. In this embodiment, the connection part between the upstream flow path 500 and the downstream flow path 600 is sealed by using the seal member 230, and thus the leakage of ink can be suppressed and inconvenience such as a short circuit of the wiring can be suppressed. Methods such as the fastening of a screw and adhesion using an adhesive may be employed to fix the upstream flow path member 210 and the downstream flow path member 220. In this embodiment, the upstream flow path member 210 and the downstream flow path member 220 are fastened by using a screw, although not particularly illustrated, and thus the upstream flow path member 210 and the downstream flow path member 220 can be disassembled with ease. Accordingly, any one of the upstream flow path member 210 and the downstream flow path member 220 that is defective can be replaced, and the yield can be more improved than when the entire flow path member 200 is replaced. In addition, the upstream flow path member 210 is easily removable from the downstream flow path member 220, and thus reverse cleaning, through which foreign substances in the upstream flow path 500 and on the filter 216 are cleaned through the reflux of a cleaning solution to the upstream flow path 500 of the upstream flow path member 210, or the like can be performed with ease. In a case where the upstream flow path member 210 and the downstream flow path member 220 are adhered by using an adhesive, the upstream flow path 500 and the downstream flow path 600 may be allowed to communicate with each other, through the adhesion of the first protruding portion 217 with the second protruding portion 221, with the seal member 230 not disposed.

A method for fixing the flow path member 200 and the liquid discharge unit pairs 1001 and 1002 is not particularly limited, and examples thereof may include adhesion by using an adhesive and fixing by using a screw. However, fixing via a seal member formed of an elastic material is difficult because the liquid discharge unit pairs 1001 and 1002 are small in size and a plurality of the liquid discharge unit pairs 1001 and 1002 have to be mounted on the single flow path member 200. Accordingly, it is preferable that the liquid discharge unit pairs 1001 and 1002 and the flow path member 200 be adhered by using an adhesive.

As described above, the flow path members that are highly complex in structure and small in size (that is, the upstream flow path member 210 and the downstream flow path member 220) are connected to the case members 40A and 40B, and thus the arrangement of the inlet 44 is important in designing the upstream flow path member 210 and the downstream flow path member 220. In this embodiment, the positions of the first inlet 44A and the second inlet 44B are shifted in the first direction X, and thus the distance between the first inlet 44A and the second inlet 44B can be increased without increasing the distance between the rows of the nozzles and constraints on the design of the upstream flow path member 210 and the downstream flow path member 220 are relaxed. In addition, the positions of the first inlet 44A and the second inlets 44F to 44H are also shifted in the first direction X, and thus the distance between the first inlet 44A and the second inlets 44F to 44H can be increased without increasing the distance between the rows of the nozzles and constraints on the design of the upstream flow path member 210 and the downstream flow path member 220 are relaxed.

In this embodiment, the positions of the first inlet 44A and the second inlet 44B are shifted in the first direction X (not to overlap in the second direction Y), and the positions of the first inlet 44A and the second inlets 44F to 44H do not overlap in the second direction Y, either. As such, the gap between the rows of the nozzles can remain narrow, a sufficient thickness of the flow path member forming the flow path can be ensured, sufficient mechanical strength can be ensured, a sufficient area for adhesion can be ensured, and the upstream flow path member 210 and the downstream flow path member 220 can be compact in size.

FIG. 8A schematically illustrates the position of the inlet 44 that is disposed in the case member 40 according to the embodiment described above, but the invention is not limited thereto. FIG. 8A schematically illustrates the filter 216 in a plan view. As is illustrated, the first inlet 44A and the second inlet 44B are shifted in the first direction X not to overlap in the second direction Y and the positions of the first inlet 44A and the second inlets 44F to 44H also do not overlap in the second direction Y so that the degree of freedom increases in designing the upstream flow path member 210 and the downstream flow path member 220 and the area where the filter 216 is disposed can also be ensured with ease. In a case where liquid discharge units 1003A and 1003B (in which the positions of the first inlet 44A and the second inlet 44B overlap in the second direction Y) are used instead of the liquid discharge units 1001A and 1001B as illustrated in FIG. 8B, the positions of the first inlet 44A and the second inlets 44F to 44H are close to each other and the filter 216 of the liquid discharge units 1003A and 1003B and the filter 216 of the liquid discharge units 1002A and 1002B buffer, resulting in the disadvantage that the filters 216 cannot be sufficiently large in size.

Figure 9A:
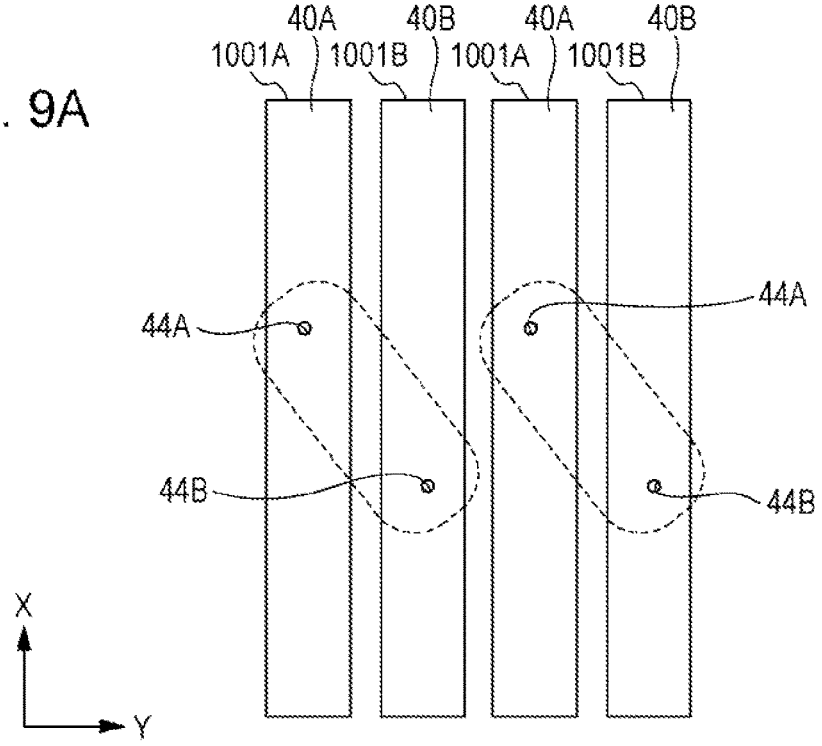
FIGS. 9A and 9B are schematic plan views illustrating an arrangement of the inlet of the ink jet type recording head.
Figure 9B:
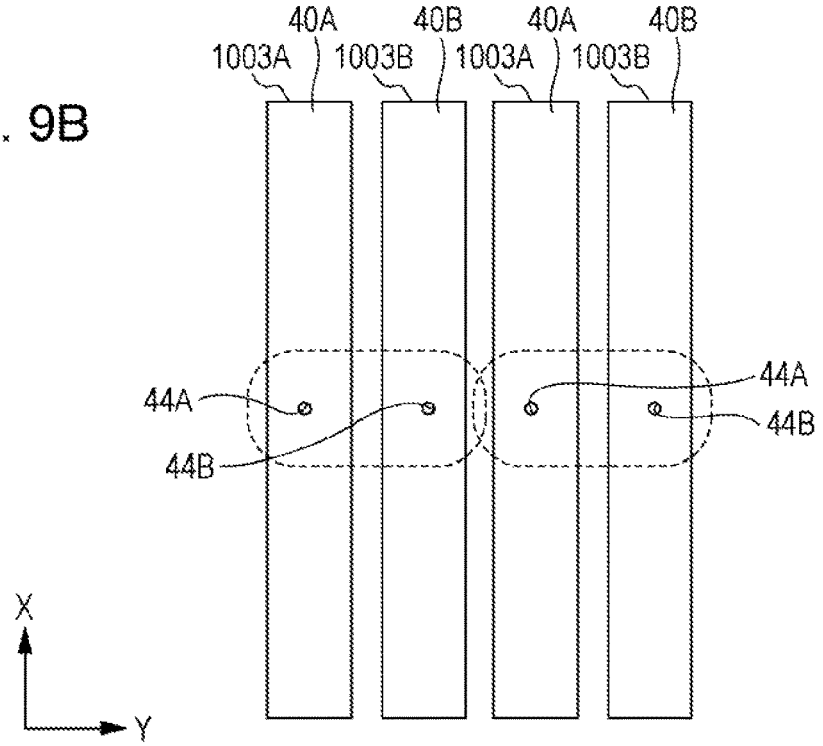

FIG. 9A illustrates a modification example of this embodiment, and the two first liquid discharge unit pairs 1001 are combined in this example. FIG. 9B is an example in which two sets of the liquid discharge units 1003A and 1003B described above are arranged for comparison purposes. In FIG. 9A, the first inlet 44A and the second inlet 44B are shifted in the first direction X and do not overlap in the second direction Y. As such, the gap between the rows of the nozzles can remain narrow, a sufficient thickness of the flow path member forming the flow path can be ensured, sufficient mechanical strength can be ensured, a sufficient area for adhesion can be ensured, and the upstream flow path member 210 and the downstream flow path member 220 can be compact in size as in the embodiment described above. In addition, the degree of freedom increases in designing the upstream flow path member 210 and the downstream flow path member 220 and the area where the filter 216 is disposed can also be ensured with ease.

Figure 10:
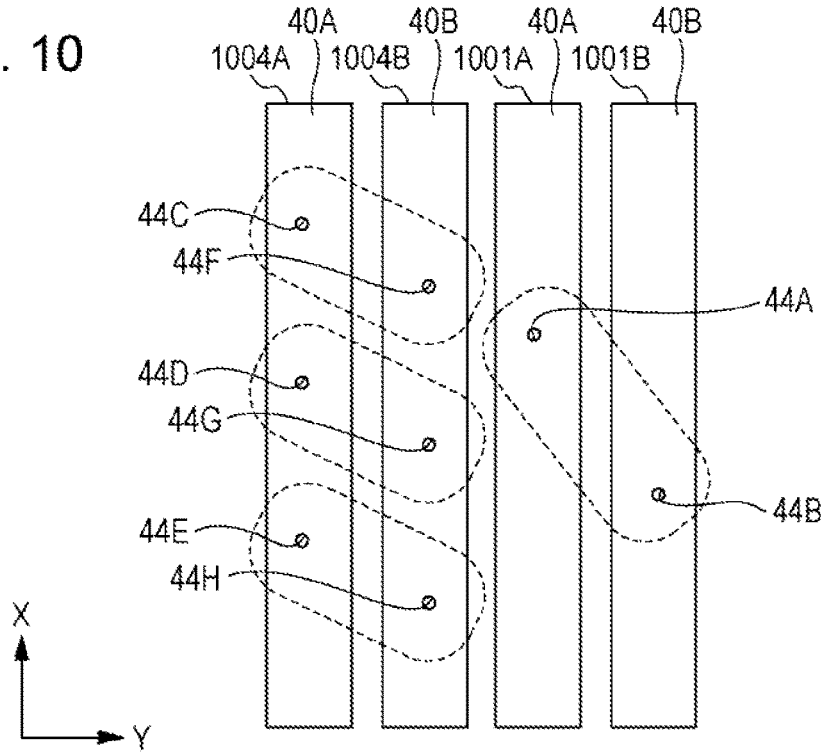
FIG. 10 is a schematic plan view illustrating an arrangement of the inlet of the ink jet type recording head.

In addition, in FIG. 10 that illustrates another modification example, liquid discharge units 1004A and 1004B (in which the positions of the inlets 44C to 44E and the inlets 44F to 44H in the first direction X are shifted) are provided instead of the liquid discharge units 1002A and 1002B of the liquid discharge unit pair 1002. Even in this case, the gap between the rows of the nozzles can remain narrow, a sufficient thickness of the flow path member forming the flow path can be ensured, sufficient mechanical strength can be ensured, a sufficient area for adhesion can be ensured, and the upstream flow path member 210 and the downstream flow path member 220 can be compact in size as in the embodiment described above. In addition, the degree of freedom increases in designing the upstream flow path member 210 and the downstream flow path member 220 and the area where the filter 216 is disposed can also be ensured with ease.

Figure 11:
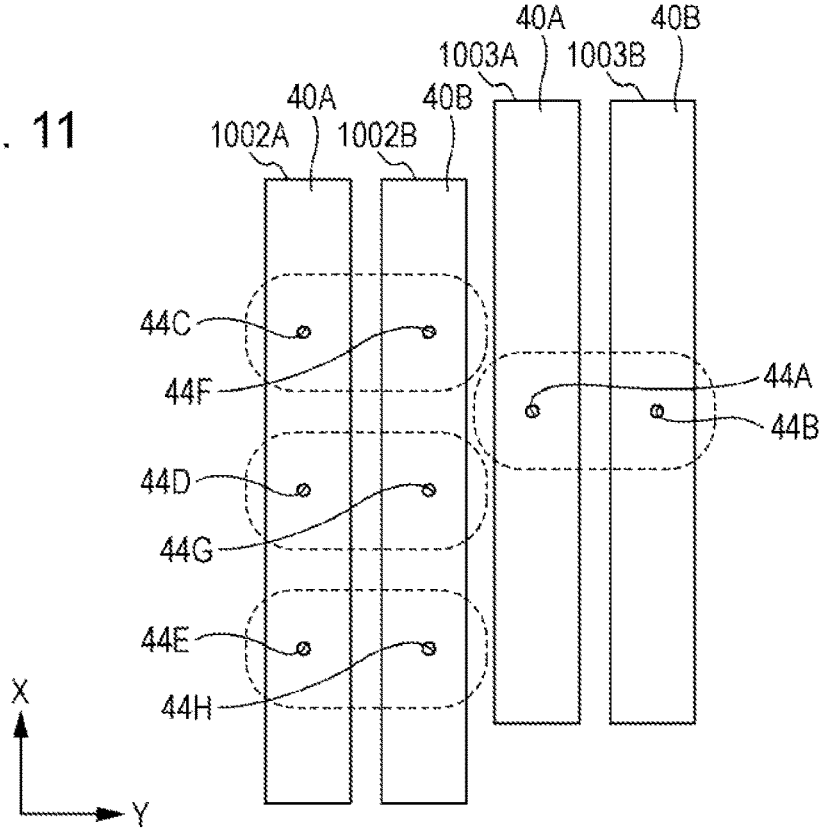
FIG. 11 is a schematic plan view illustrating an arrangement of the inlet of the ink jet type recording head.
Figure 12:
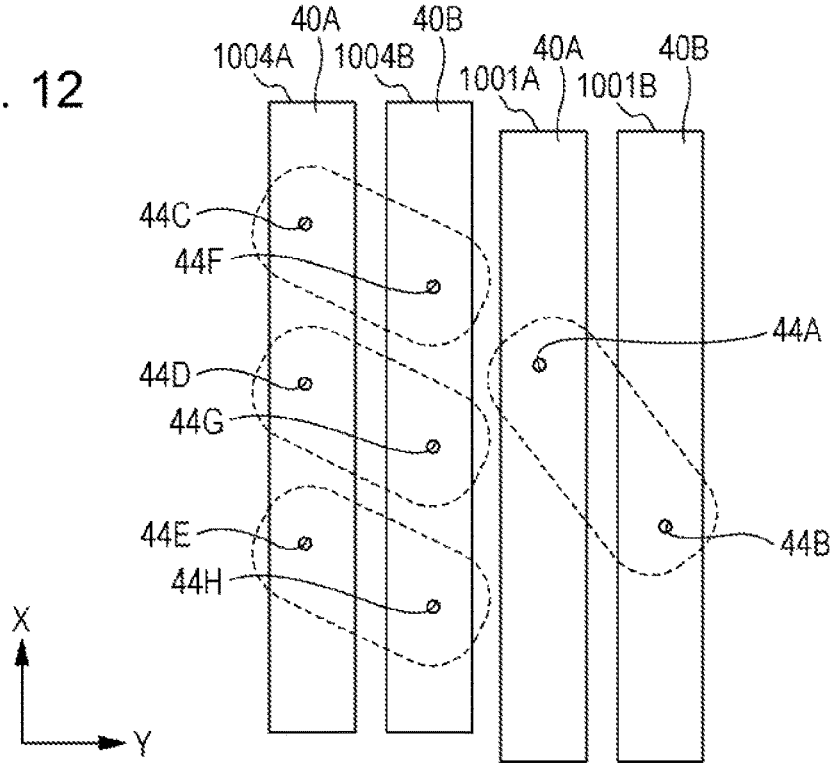
FIG. 12 is a schematic plan view illustrating an arrangement of the inlet of the ink jet type recording head.

In addition, such effects of the invention can be achieved not only when the positions of the inlets disposed in the case members are configured to be shifted in the first direction X but also when the positions where the adjacent liquid discharge units are arranged are shifted in the first direction X or when both of these are configured to be combined. FIGS. 11 and 12 are schematic views illustrating these examples.

FIG. 11 illustrates an example in which the liquid discharge units 1003A and 1003B, which have the case members 40A and 40B where the positions of the inlets 44A and 44B are arranged at the center in the first direction X, are provided instead of the liquid discharge units 1001A and 1001B and the positions where the liquid discharge units 1003A and 1003B and the liquid discharge units 1002A and 1002B are arranged in the first direction X are configured to be shifted. In this case, the positions of the first inlet 44A and the second inlets 44F to 44H are shifted in the first direction X and do not overlap in the second direction Y, and the effects described above are achieved.

FIG. 12 is the same as FIG. 10 in that the liquid discharge units 1001A and 1001B and the liquid discharge units 1004A and 1004B are provided. However, in FIG. 12, the arrangements of the liquid discharge units 1001A and 1001B and the liquid discharge units 1003A and 1003B in the first direction X are shifted not to overlap in the second direction Y. In this manner, the distance between the first inlet 44A and the second inlets 44F to 44H is further increased than in FIG. 10 and the effects described above can be achieved to an even more significant extent.

Figure 13:
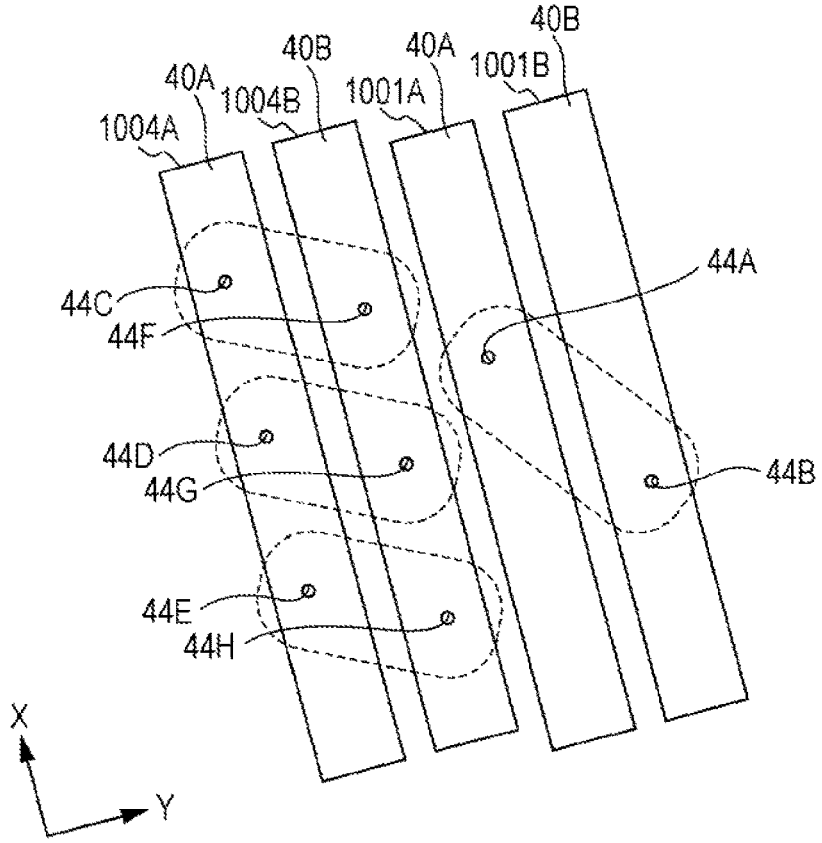
FIG. 13 is a schematic plan view illustrating an arrangement of the inlet of the ink jet type recording head.

In addition, an example in which the second direction Y is consistent with the scanning direction of the liquid discharge head has been described in the example described above, but the second direction Y may intersect with the scanning direction and the liquid discharge unit may be arranged at an angle. FIG. 13 illustrates this example. The configuration illustrated in FIG. 13 is the same as that illustrated in FIG. 12, except that the liquid discharge unit is arranged at an angle, and the same effects are achieved.

Figure 14:
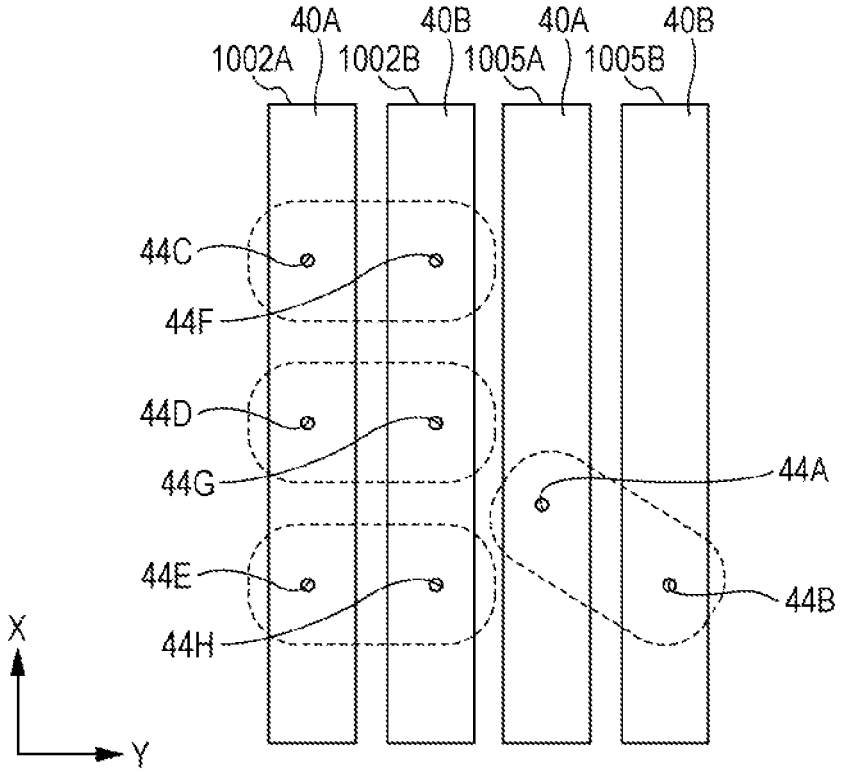
FIG. 14 is a schematic plan view illustrating an arrangement of the inlet of the ink jet type recording head.

In addition, the positions of the first inlet 44A and the second inlet 44B are shifted in the direction opposite to the first direction X with the case members 40A and 40B of the liquid discharge units 1001A and 1001B in the embodiment described above, but the invention is not limited thereto and the same effects can be achieved when the shifting is performed in the same direction and the amount of the shift differs. FIG. 14 illustrates this example. In liquid discharge units 1005A and 1005B, the positions of the first inlet 44A and the second inlet 44B are shifted in the same direction from the central positions of the pressure generating chambers 12 at both of the ends in the first direction X (that is, the downward direction in the drawing) and the amount of the shift is changed so that the same effects as in the embodiment described above are achieved.

In addition, the cover heads 400 are disposed on the surface side of the flow path member 200 where the liquid discharge unit pairs 1001 and 1002 are disposed. In this embodiment, the cover heads 400 have a sufficient size to cover the plurality of liquid discharge unit pairs. In addition, a second exposing opening portion 401 (which exposes the nozzles 21) is disposed in the cover head 400. In this embodiment, the second exposing opening portion 401 has a sufficient size to expose the nozzle plate 20 (that is, an opening substantially the same as the first exposing opening portion 45*a* of the compliance substrate 45).

The cover head 400 is bonded to the surface side of the compliance substrate 45 opposite to the communicating plate 15 and seals the space on the side of the compliance portion 49 opposite to the flow path (manifold 100). When the compliance portion 49 is covered by the cover head 400 in this manner, breakage of the compliance portion 49 attributable to contact with a recording medium such as paper can be suppressed. In addition, attachment of ink (liquid) to the compliance portion 49 can be suppressed, ink (liquid) attached to a surface of the cover head 400 can be wiped with, for example, a wiper blade, and contamination of the recording medium by ink attached to the cover head 400 or the like can be suppressed. Although not particularly illustrated, a space between the cover head 400 and the compliance portion 49 is open to the atmosphere. The cover head 400 may also be disposed independently in each of the liquid discharge unit pairs 1001 and 1002.

Other Embodiments

An embodiment of the invention has been described above, but the basic configuration of the invention is not limited to the above description.

For example, the two liquid discharge unit pairs and the four liquid discharge units are disposed in the recording head 1 according to the first embodiment described above, but the number of the liquid discharge units is not particularly limited thereto. The recording head 1 may include only one liquid discharge unit pair or the recording head 1 may include five or more liquid discharge units. In addition, an example in which the first liquid discharge unit pair 1001 and the second liquid discharge unit pair 1002 are configured to be disposed in the recording head 1 has been described in the embodiment described above, but the invention is not limited thereto and only one of the first liquid discharge unit pair 1001 and the second liquid discharge unit pair 1002 may be disposed in the recording head 1. The configuration of the liquid discharge unit pairs 1001 and 1002 is not limited to the above description.

In addition, the first connection flow path 600A and the second connection flow path 600B that are connected to the one liquid discharge unit pair are connected to the upstream flow path 500 (which is a common flow path that is common) in the first embodiment described above. However, the invention is not particularly limited thereto, and the first connection flow path 600A and the second connection flow path 600B may communicate with respective flow paths independent from each other.

Furthermore, the flow path member 200 that has the upstream flow path member 210 where the upstream flow path 500 is disposed and the downstream flow path member 220 where the downstream flow path 600 is disposed has been described as an example in the first embodiment described above, but the upstream and the downstream may be reversed in a case where ink (liquid) is circulated. In other words, ink that is supplied to the liquid discharge unit pairs 1001 and 1002 may be allowed to flow from the downstream flow path 600 to the upstream flow path 500 and may be discharged (circulated) to the liquid holding portion, a storage portion where discharge ink is stored, and the like.

In addition, the thin film type piezoelectric actuator 130 has been used in the description of the first embodiment above as the pressure generating unit that causes pressure change in the pressure generating chamber 12, but the invention is not limited thereto. For example, a thick film type piezoelectric actuator that is formed by using a method such as green sheet pasting, a vertical vibration type piezoelectric actuator in which a piezoelectric material and an electrode forming material are stacked alternately to be expanded and contracted in an axial direction, and the like can also be used. In addition, what discharges liquid droplets from a nozzle opening by using bubbles that are generated through heating by heater elements which are arranged in a pressure generating chamber as a pressure generating unit, a so-called electrostatic actuator that discharges liquid droplets from a nozzle opening by deforming a vibrating plate with the electrostatic force of static electricity that is generated between the vibrating plate and an electrode, and the like can also be used.

Figure 15:
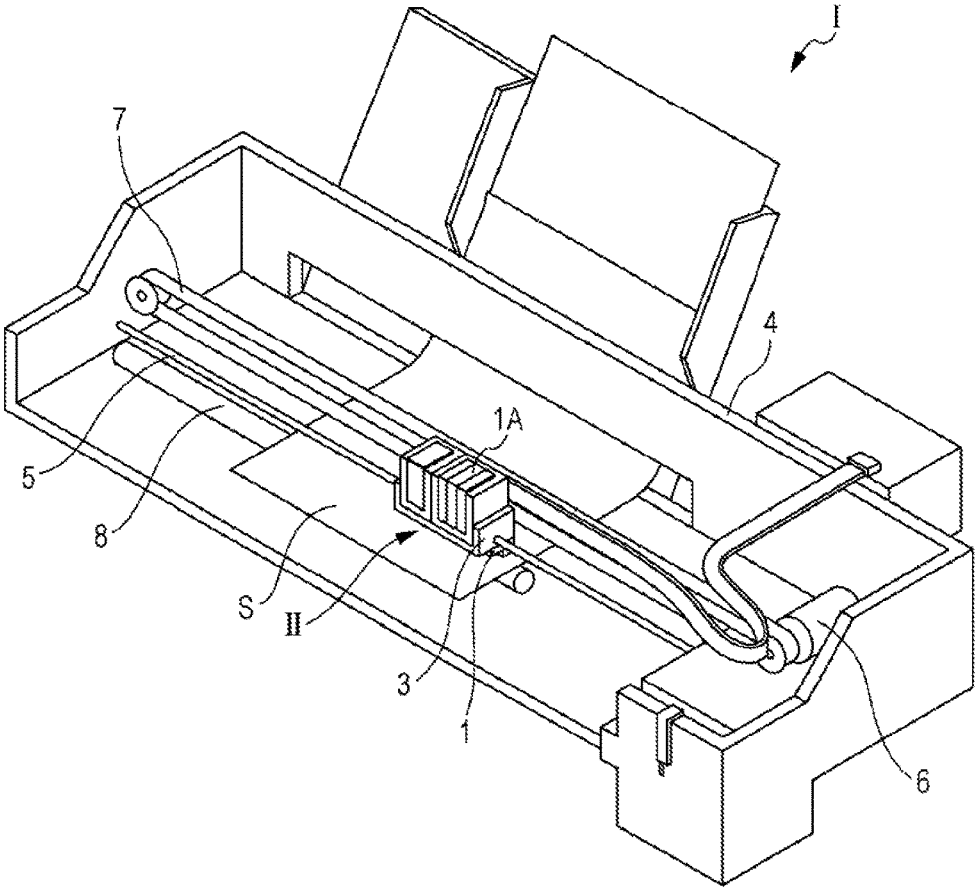
FIG. 15 is a schematic view illustrating an example of the ink jet type recording apparatus.

In addition, the ink jet type recording head 1 according to the first embodiment constitutes a part of an ink jet type recording head unit that includes an ink flow path which communicates with an ink cartridge and the like, and is mounted on an ink jet type recording apparatus. FIG. 15 is a schematic view illustrating an example of the ink jet type recording apparatus.

In an ink jet type recording head unit II (hereinafter, referred to the head unit II), which has a plurality of the ink jet type recording heads 1, of an ink jet type recording apparatus I illustrated in FIG. 15, a cartridge that constitutes the liquid holding portion is removably disposed and a carriage 3 (on which the head unit II is mounted) is disposed on a carriage shaft 5, which is mounted on an apparatus main body 4, to be movable in the axial direction. The recording head unit II discharges, for example, a black ink composition and a color ink composition.

When the driving force of a drive motor 6 is transmitted to the carriage 3 via a plurality of gears (not illustrated) and a timing belt 7, the carriage 3 that is mounted on the head unit II is moved along the carriage shaft 5. A platen 8 is disposed along the carriage shaft 5 in the apparatus main body 4. A recording sheet S, which is a recording medium such as paper fed by a feed roller (not illustrated), is wound around the platen 8 and transported.

In addition, the ink jet type recording apparatus I in which the ink jet type recording head 1 (head unit II) is mounted on the carriage 3 and is moved in a main scanning direction has been described above, but the invention is not limited thereto. For example, the invention can also be applied to a so-called line type recording apparatus that performs printing by moving the recording sheet S such as paper only in a sub-scanning direction with the ink jet type recording head 1 fixed thereto.

In addition, an ink cartridge 1A, which is a liquid holding portion, is configured to be mounted on the carriage 3 in the ink jet type recording apparatus I according to the example described above, but the invention is not limited thereto. For example, the liquid holding portion such as an ink tank may be fixed to the apparatus main body 4 and the liquid holding portion and the ink jet type recording head 1 may be connected via a supply tube such as a tube. In addition, the liquid holding portion may not be mounted on the ink jet type recording apparatus.

Furthermore, the invention targets a wide range of liquid ejecting heads in general. For example, the invention can also be applied to recording heads such as various types of ink jet type recording heads used in image recording apparatuses such as printers, color material ejecting heads used in manufacturing color filters such as liquid crystal displays, electrode material ejecting heads used in forming electrodes such as organic EL displays and field emission displays (FED), bio-organic material ejecting heads used in manufacturing biochips, and the like.

This application is a continuation application of U.S. patent application Ser. No. 14/455,770, filed Aug. 8, 2014, which patent application is incorporated herein by reference in its entirety. U.S. patent application Ser. No. 14/455,770 claims the benefit of and priority to Japanese Patent Application No: 2013-167010, filed Aug. 9, 2013 is expressly incorporated by reference herein in its entirety.

What is claimed is:

1. A liquid ejecting head comprising:

first and second discharge units that each include a plurality of pressure generating chambers disposed in a first direction, and a case member which corresponds to each of the first and second liquid discharge units and holds a liquid, wherein the case member of each of the liquid discharge units has a plurality of liquid inlets on a side opposite to a liquid discharge direction and at a position between both ends in the first direction of the plurality of pressure generating chambers in a plan view, and wherein the first liquid discharge unit and the second liquid discharge unit are arranged side by side in a second direction that is orthogonal to the first direction, and each position of the liquid inlets of the case member of the first liquid discharge unit is offset from each position of the liquid inlets of the case member of the second liquid discharge unit in both the first direction and the second direction.

2. The liquid ejecting head according to claim 1, wherein a flow path member, which has merging flow paths communicating respectively with the liquid inlet of the first liquid discharge unit and the liquid inlet of the second liquid discharge unit, is disposed across the first liquid discharge unit and the second liquid discharge unit.

3. The liquid ejecting head according to claim 1, wherein a filter that is disposed upstream the flow path which communicates with the liquid inlet of the first liquid discharge unit and a filter that is disposed upstream the flow path which communicates with the liquid inlet of the second liquid discharge unit are integrated with each other.

4. The liquid ejecting head according to claim 1, wherein the first liquid discharge unit and the second liquid discharge unit collectively comprise a first unit pair and one or more additional unit pairs are present in a juxtaposed manner with each other and with the first unit pair, positions of the liquid inlets of one of the additional unit pairs and the liquid inlets of the first other unit pair do not overlap in the second direction.

5. The liquid ejecting head according to claim 4, wherein a flow path member, which has merging flow paths respectively communicating with the liquid inlets of the first liquid discharge unit and the liquid inlets of the second liquid discharge unit of the first unit pair and a first liquid inlet of the first liquid discharge unit and the liquid inlets of the second liquid discharge unit of one of the additional unit pairs, is disposed across all of the first liquid discharge units and the second liquid discharge units of the first unit pair and the one of the additional unit pair.

6. The liquid ejecting head according to claim 4, wherein a filter that is disposed upstream the flow paths which communicate with the liquid inlets of all of the first liquid discharge units and a filter that is disposed upstream the flow paths which communicate with the liquid inlets of all of the second liquid discharge units of the first unit pair and the one of the additional unit pair are integrated with each other.

7. The liquid ejecting head according to claim 4, wherein an end of the first unit pair in the first direction is shifted from an end of one of the additional unit pairs in the first direction.

8. The liquid ejecting head according to claim 1, wherein the liquid inlets of the first liquid discharge unit and the liquid inlets of the second liquid discharge unit are disposed at the center between the pressure generating chambers at both of the ends in the first direction.

9. The liquid ejecting head according to claim 1, wherein the offset between the liquid inlets of the case member of the first liquid discharge unit and the liquid inlets of the second liquid discharge unit are the same in both the first and second directions.

10. The liquid ejecting head according to claim 1, wherein the second direction intersects with a scanning direction.

11. A liquid ejecting apparatus comprising a liquid ejecting head, the liquid ejecting head comprising:

first and second discharge units that each include a plurality of pressure generating chambers disposed in a first direction, and a case member which corresponds to each of the first and second liquid discharge units and holds a liquid, wherein the case member of each of the liquid discharge units has a plurality of liquid inlets on a side opposite to a liquid discharge direction and at a position between both ends in the first direction of the plurality of pressure generating chambers in a plan view, and wherein the first liquid discharge unit and the second liquid discharge unit are arranged side by side in a second direction that is orthogonal to the first direction, and each position of the liquid inlets of the case member of the first liquid discharge unit is offset from each position of the liquid inlets of the case member of the second liquid discharge unit in both the first direction and the second direction.

12. The liquid ejecting apparatus according to claim 11, wherein a flow path member, which has merging flow paths communicating respectively with the liquid inlets of the first liquid discharge unit and the liquid inlets of the second liquid discharge unit, is disposed across the first liquid discharge unit and the second liquid discharge unit.

13. The liquid ejecting apparatus according to claim 11, wherein a filter that is disposed upstream the flow path which communicates with the liquid inlet of the first liquid discharge unit and a filter that is disposed upstream the flow path which communicates with the liquid inlet of the second liquid discharge unit are integrated with each other.

14. The liquid ejecting apparatus according to claim 11, wherein the first liquid discharge unit and the second liquid discharge unit collectively comprise a first unit pair and one or more additional unit pairs are present in a juxtaposed manner with each other and with the first unit pair, positions of the liquid inlets of one of the additional unit pairs and the liquid inlets of the first other unit pair do not overlap in the second direction.

15. The liquid ejecting apparatus according to claim 14, wherein a flow path member, which has merging flow paths respectively communicating with the liquid inlets of the first liquid discharge unit and the liquid inlets of the second liquid discharge unit of the first unit pair and a first liquid inlet of the first liquid discharge unit and the liquid inlets of the second liquid discharge unit of one of the additional unit pairs, is disposed across all of the first liquid discharge units and the second liquid discharge units of the first unit pair and the one of the additional unit pair.

16. The liquid ejecting apparatus according to claim 14, wherein a filter that is disposed upstream the flow paths which communicate with the liquid inlets of all of the first liquid discharge units and a filter that is disposed upstream the flow paths which communicate with the liquid inlets of all of the second liquid discharge units of the first unit pair and the one of the additional unit pair are integrated with each other.

17. The liquid ejecting apparatus according to claim 11, wherein the liquid inlets of the first liquid discharge unit and the liquid inlets of the second liquid discharge unit are disposed at the center between the pressure generating chambers at both of the ends in the first direction.

18. The liquid ejecting apparatus according to claim 11, wherein the offset between the liquid inlets of the case member of the first liquid discharge unit and the liquid inlets of the second liquid discharge unit are the same in both the first and second directions.

* * * * *